US010141134B2

(12) United States Patent
Koshimura et al.

(10) Patent No.: US 10,141,134 B2
(45) Date of Patent: Nov. 27, 2018

(54) KEY SWITCH AND KEYBOARD

(71) Applicant: FUJITSU COMPONENT LIMITED, Tokyo (JP)

(72) Inventors: Katsuaki Koshimura, Tokyo (JP); Masahiro Kaneko, Tokyo (JP); Nobuo Yatsu, Tokyo (JP); Miki Kitahara, Tokyo (JP); Kohei Takahashi, Tokyo (JP); Chuqi Liang, Tokyo (JP)

(73) Assignee: FUJITSU COMPONENT LIMITED, TOKYO (JP)

( * ) Notice: Subject to any disclaimer, the term of this patent is extended or adjusted under 35 U.S.C. 154(b) by 0 days.

(21) Appl. No.: 15/635,654

(22) Filed: Jun. 28, 2017

(65) Prior Publication Data

US 2018/0090287 A1 Mar. 29, 2018

(30) Foreign Application Priority Data

Sep. 28, 2016 (JP) ..... 2016-189685

(51) Int. Cl.
*H01H 13/14* (2006.01)
*H01H 13/705* (2006.01)
*H01H 13/704* (2006.01)

(52) U.S. Cl.
CPC ..... *H01H 13/705* (2013.01); *H01H 13/14* (2013.01); *H01H 13/704* (2013.01); *H01H 2221/058* (2013.01)

(58) Field of Classification Search
CPC ..... H01H 3/125; H01H 13/83; H01H 13/705; H01H 2215/006; H01H 13/14; H01H 13/704; H01H 2221/058; H01H 13/70
USPC ..... 200/5 A, 314, 341–345
See application file for complete search history.

(56) References Cited

U.S. PATENT DOCUMENTS 5,382,762 A 1/1995 Mochizuki
5,512,719 A * 4/1996 Okada ..... H01H 3/125 200/344
5,590,020 A * 12/1996 Sellers ..... G06F 1/1616 200/341
5,828,015 A * 10/1998 Coulon ..... H01H 3/125 200/5 A
7,183,512 B2 * 2/2007 Lee ..... H01H 3/125 200/344

(Continued)

FOREIGN PATENT DOCUMENTS

CN 105206458 12/2015
JP H06-017057 U 3/1994

(Continued)

*Primary Examiner* — Ahmed Saeed
(74) *Attorney, Agent, or Firm* — IPUSA, PLLC

(57) ABSTRACT

A key switch includes a key top; a pair of links that support the key top such that the key top is capable of being elevated and lowered; and a switch that opens and closes a contact point with respect to an elevating operation of the key top, wherein each of the links includes two arms, a connection portion that connects the two arms, two first shafts respectively formed at outer portions of the two arms, and two second shafts respectively formed at inner portions of the two arms, and wherein the key top includes at least four first support portions each being provided with a first guide groove in which the respective first shaft is slidable, and at least four second support portions each being provided with a second guide groove in which the respective second shaft is slidable.

7 Claims, 26 Drawing Sheets

(56) References Cited

U.S. PATENT DOCUMENTS

| | | | | |
|---|---|---|---|---|
| 8,080,744 | B2 * | 12/2011 | Yeh | H01H 3/125 200/5 A |
| 8,779,308 | B2 | 7/2014 | Takemae et al. | |
| 8,957,337 | B2 * | 2/2015 | Niu | H01H 3/125 200/344 |
| 9,224,552 | B2 * | 12/2015 | Lee | H01H 13/7006 |
| 2009/0260970 | A1 * | 10/2009 | Tsai | H01H 3/125 200/5 A |

FOREIGN PATENT DOCUMENTS

| | | |
|---|---|---|
| JP | 2012-182107 | 9/2012 |
| TW | 431641 | 4/2001 |

* cited by examiner

KEY SWITCH AND KEYBOARD

CROSS-REFERENCE TO RELATED APPLICATION

The present application is based on and claims the benefit of priority of Japanese Priority Application No. 2016-189685 filed on Sep. 28, 2016, the entire contents of which are hereby incorporated by reference.

BACKGROUND OF THE INVENTION

1. Field of the Invention

The present invention relates to a key switch and a keyboard.

2. Description of the Related Art

Small and thin electronic devices such as notebook personal computers are desired, and thus, a thin keyboard including a plurality of key switches is mounted on the electronic device. For example, a key switch of a gear link type includes a support plate, a key top, links provided between the support plate and the key top to cause an elevating operation of the key top, and a membrane switch that switches on and off a contact point of an electric circuit in accordance with the elevating operation of the key top. The links are attached on the support plate by a frame-shaped housing, and the membrane switch is provided between the support plate and the links.

Here, a key switch used in a thin keyboard includes a thin key top. However, when the key top is thin, the key top is deflected when a corner of the key top is pressed. Thus, a center of the key top is floated. When inputting data from the keyboard, the key switch is on when the key top is operated to press the membrane switch. However, when a corner of the key top is pressed and the center of the key top is floated, a keystroke necessary to switch on the membrane switch becomes longer than a case when the center of the key top is pressed, for example. Thus, the membrane switch may not be switched on even when the key top is pressed, data cannot be input by the keyboard, and usability is worsened.

When the key top is thick and rigidity is increased, deflection of the key top does not occur. However, if the key top is thick, the key switch becomes also thick, and it is impossible to satisfy the requirement of providing a thin keyboard.

PATENT DOCUMENTS

[Patent Document 1] Japanese Laid-open Utility Model Publication No. H06-17057

[Patent Document 2] Japanese Laid-open Patent Publication No. 2012-182107

SUMMARY OF THE INVENTION

According to an embodiment, there is provided a key switch including a key top; a pair of links that support the key top such that the key top is capable of being elevated and lowered; and a switch that opens and closes a contact point with respect to an elevating operation of the key top, wherein each of the links includes two arms, a connection portion that connects the two arms, two first shafts respectively formed at outer portions of the two arms, and two second shafts respectively formed at inner portions of the two arms, and wherein the key top includes at least four first support portions each being provided with a first guide groove in which the respective first shaft is slidable, and at least four second support portions each being provided with a second guide groove in which the respective second shaft is slidable.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
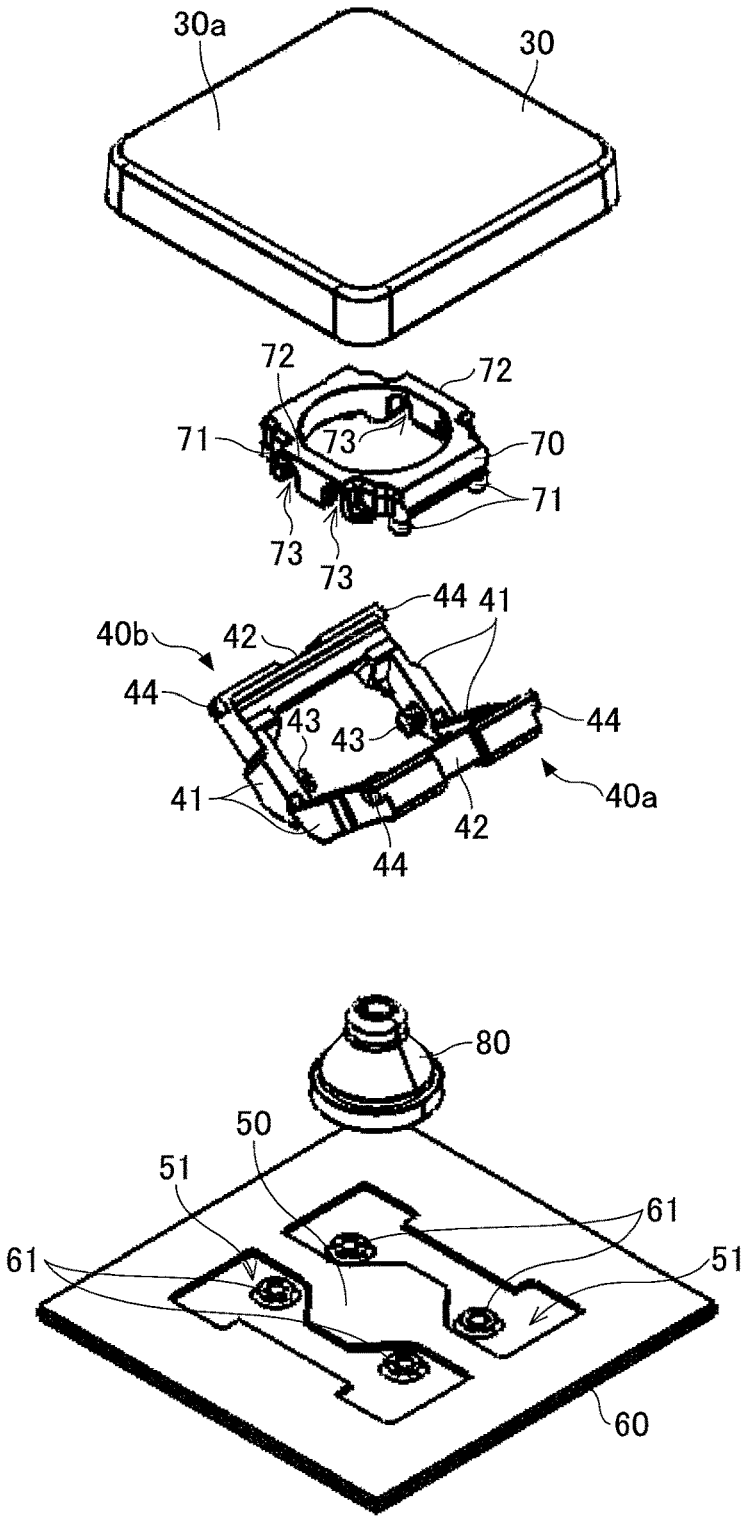
FIG. 1 is an exploded perspective view of a key switch.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

(Key Switch)

A key switch is described. FIG. 1 is an exploded perspective view illustrating a structure of a key switch.

As illustrated in FIG. 1, the key switch includes a key top 30, a pair of links 40*a* and 40*b* that cause an elevating operation of the key top 30, and a membrane switch 50 that switches on and off contact points in accordance with the elevating operation of the key top 30. The links 40*a* and 40*b* are attached to a support plate 60 by a frame-shaped housing 70. The membrane switch 50 is provided between the support plate 60 and the links 40*a* and 40*b*.

An upper surface 30*a* of the key top 30 is an operation surface that is pressed and operated by a user. The contact points of the membrane switch 50 are provided below a center of the key top 30. A rubber actuator 80 provided between the key top 30 and the membrane switch 50 deforms in accordance with a lowering operation of the key top 30 to switch on the contact points of the membrane switch 50. The membrane switch 50 is provided with two openings 51 formed such that the rubber actuator 80 is disposed therebetween.

The housing 70 is a frame member having a rectangular outer shape provided with an opening at its inside. Four protrusions 71 of the housing 70 are respectively inserted in four through-holes 61 formed in the support plate 60 via the openings 51, and adhered by an adhesive agent or the like. The rubber actuator 80 is provided inside a frame of the housing 70.

Two bearings 73 are formed at a lower portion of each of two facing side portions 72 of the frame of the housing 70. Each of the bearings 73 penetrates the respective side portion 72 in a lateral direction, and four of the bearings 73 are provided in the housing 70.

Each of the links 40*a* and 40*b* includes two arms 41 that extend in a same direction in parallel, and a connection portion 42 that connects the two arms 41. Rotatable shafts 43 are formed at inner surfaces of the two arms 41 facing with each other of each of the links 40*a* and 40*b*, respectively, at one end portion of each of the two arms 41. Each of the rotatable shafts 43 is formed in parallel with the connection portion 42, and has a cylindrical shape. The rotatable shafts 43 provided at the two arms 41 of the same link 40*a* or 40*b* and facing with each other are formed to be coaxial. The rotatable shaft 43 is rotatably provided in the respective bearing 73 of the housing 70.

Shafts 44 that protrude outwardly are formed at the two arms 41 of each of the links 40*a* and 40*b*, respectively, at the other end portion of each of the arms 41 at a base end side. Each of the shafts 44 is formed to be in parallel with the connection portion 42.

Figure 2:
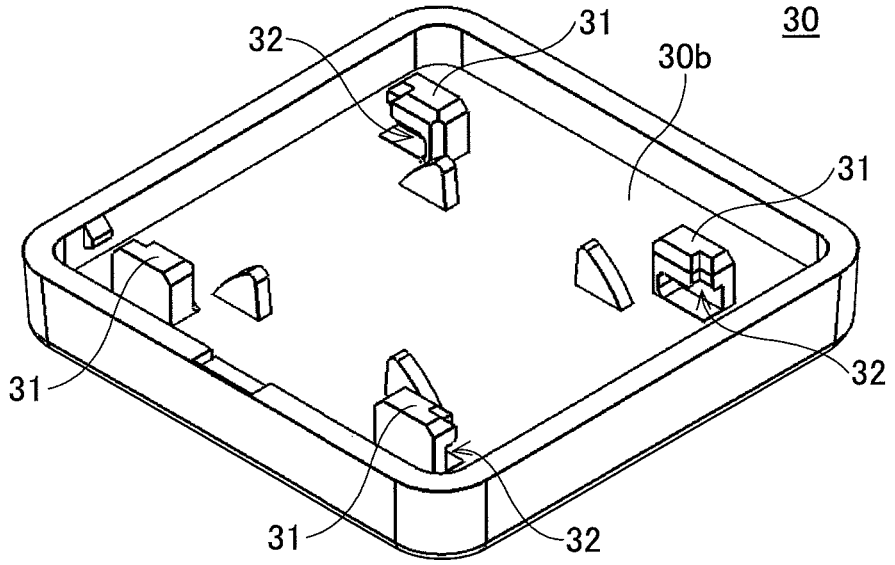
FIG. 2 is a perspective view of a key top.
Figure 3:
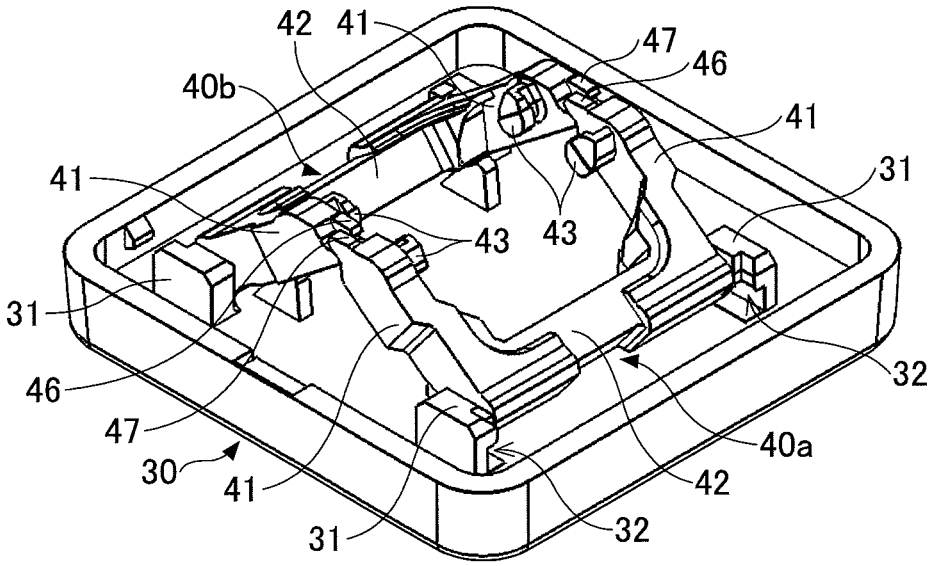
FIG. 3 is a perspective view in which links are attached to the key top.

As illustrated in FIG. 2, support portions 31 for supporting the shafts 44 are provided near four corners at a lower surface 30*b* of the key top 30, respectively. Each of the support portions 31 is provided with a guide groove 32, and as illustrated in FIG. 3, each of the shafts 44 of each of the links 40*a* and 40*b* is slidably inserted in the respective guide groove 32.

A first tooth 46 is formed at an end portion of one of the two arms 41, and a second tooth 47 is formed at an end portion of the other of the two arms 41, of each of the links 40*a* and 40*b*. Then, the first tooth 46 and the second tooth 47 of one of the links 40*a* and 40*b* respectively engage with the second tooth 47 and the first tooth 46 of the other of the links 40*a* and 40*b*.

In such a key switch, data is input when the key top 30 is pressed. When the key top 30 is not pressed, the key top 30 is supported by a top portion of the rubber actuator 80. Under this state, the key top 30 is positioned furthest from the membrane switch 50, and the membrane switch 50 is at an off-state.

When the key top 30 is pressed under this state, each of the links 40*a* and 40*b* is rotated around the rotatable shafts 43, facing with each other, as a center by a lowering operation of the key top 30, and the shafts 44 of each of the links 40*a* and 40*b* slide in the guide grooves 32, respectively. When the key top 30 is pressed to a predetermined position, a protrusion provided inside the rubber actuator 80 presses the contact points of the membrane switch 50, and the contact points of the membrane switch 50 contact with each other. With this, the membrane switch 50 becomes an on-state.

Figure 4A:
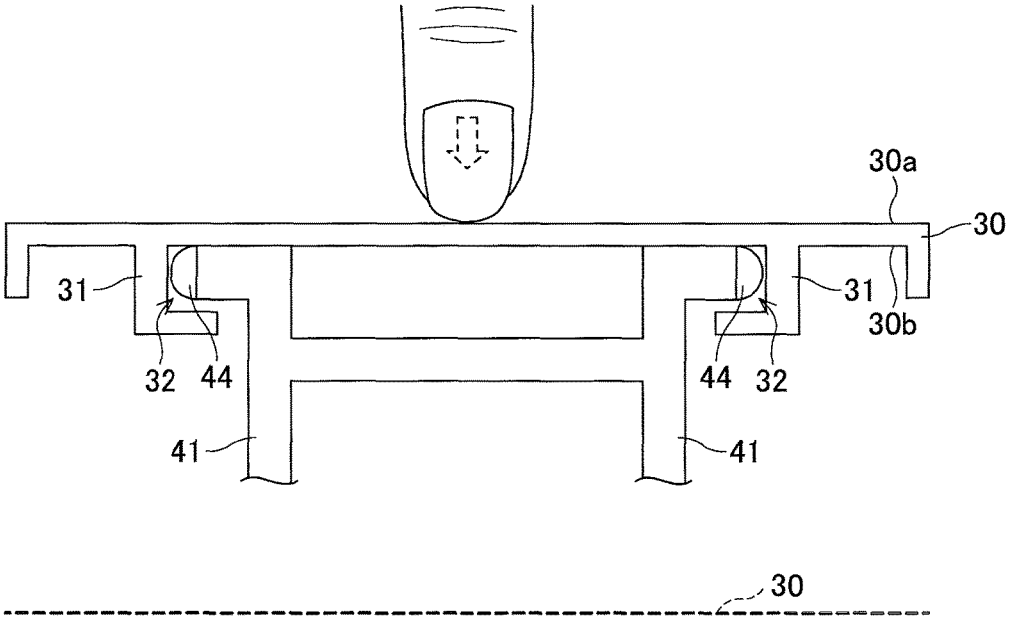
FIG. 4A and FIG. 4B are cross-sectional views of the key switch.

In this key switch, the key top 30 is made thin to provide a thin keyboard or the like. As illustrated in FIG. 4A, when a center of the key top 30 is pressed, the key top 30 is not deflected almost at all. However, as illustrated in FIG. 4B, when a portion near an edge of the key top 30 is pressed, the key top 30 is deflected.

Figure 4B:
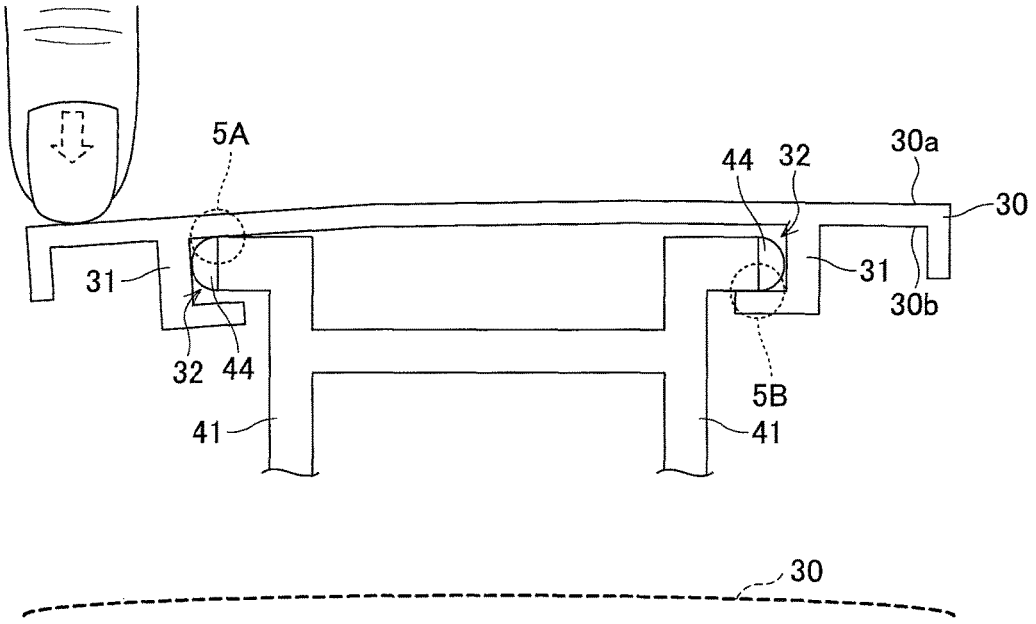

As illustrated in FIG. 4B, when a left edge of the key top 30 is pressed, an upper portion of the shaft 44 and the lower surface 30*b* of the key top 30 surrounded by a broken line circle 5A contact, and the key top 30 is deflected under a state that a lower portion of the shaft 44 and a lower portion of the guide groove 32 surrounded by a broken line circle 5B contact. Thus, a center of the key top 30 is curved and floated upward. In the key switch, as the membrane switch 50 is pressed via the rubber actuator 80 at the center of the key top 30, even when the upper surface 30*a* of the key top 30 is pressed by same force, if the edge of the key top 30 is pressed as illustrated in FIG. 4B, a distance between the center of the key top 30 and the membrane switch 50 becomes longer than that in a case illustrated in FIG. 4A. Thus, the membrane switch 50 may not become the on-state. In such a case, data is not input. Here, in FIG. 4A and FIG. 4B, a shape of a top surface of the key top 30 is illustrated by a broken line. This is the same in the following drawings.

First Embodiment

Figure 5:
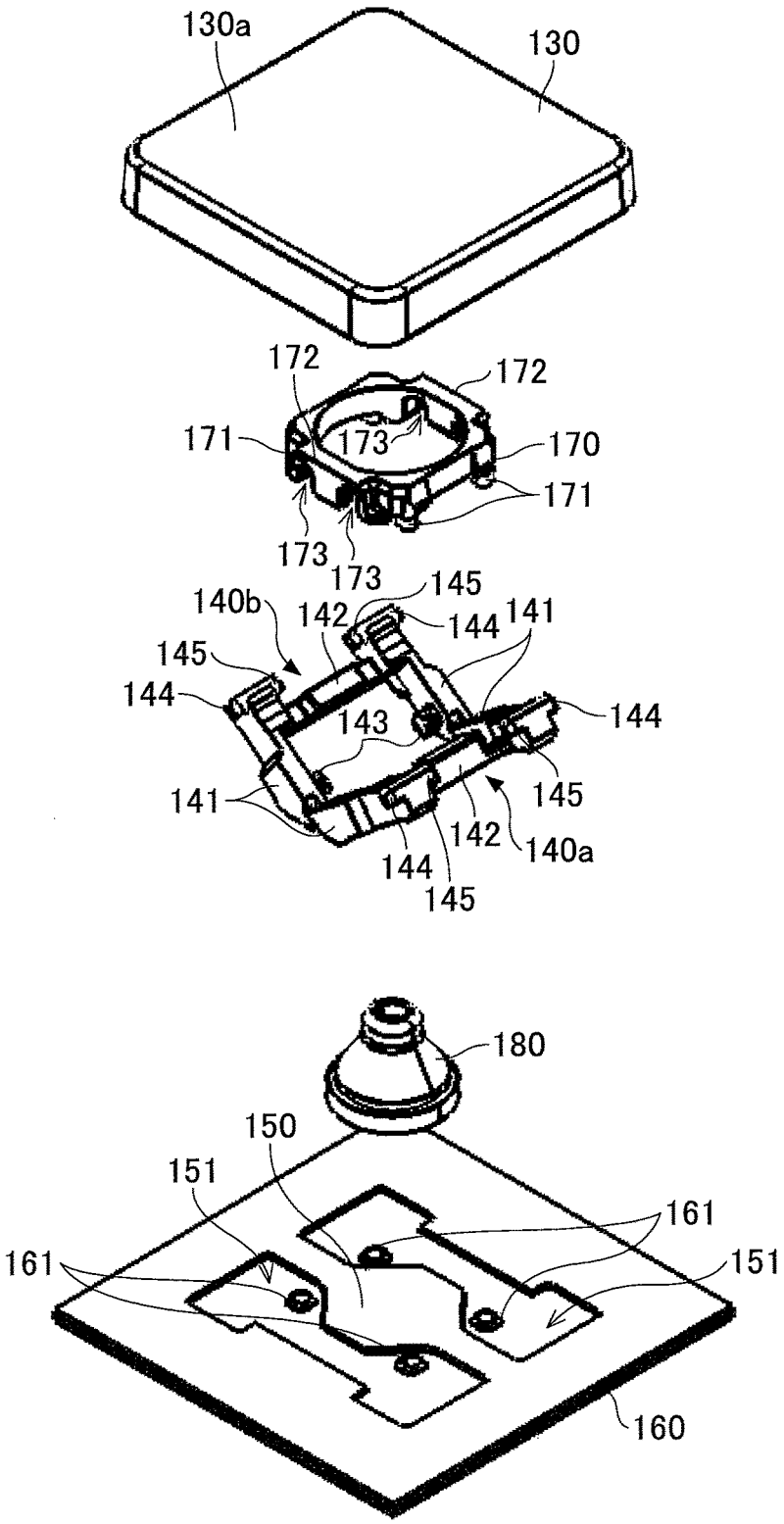
FIG. 5 is an exploded perspective view of a key switch of a first embodiment.
Figure 6:
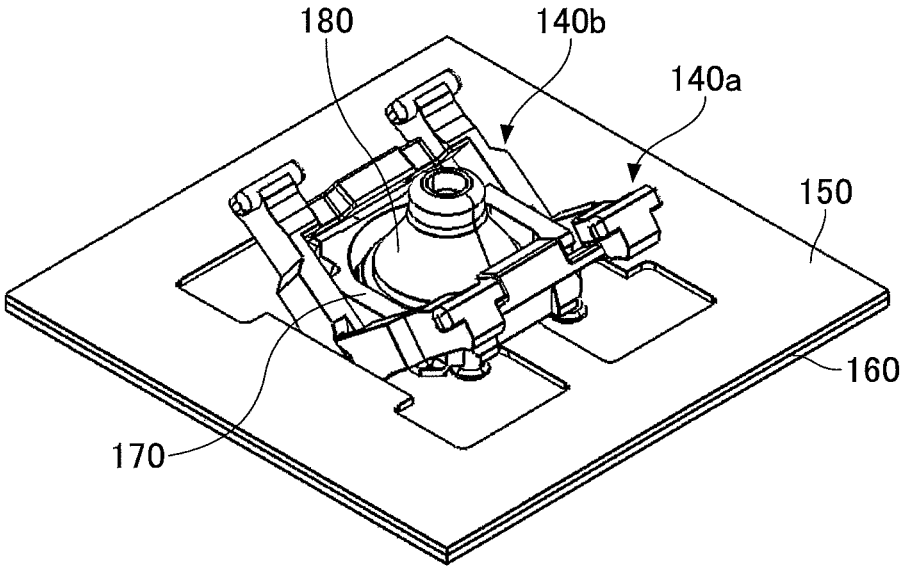
FIG. 6 is a perspective view in which links of the first embodiment are attached.

A key switch of a first embodiment is described. FIG. 5 is an exploded perspective view of the key switch of the embodiment. FIG. 6 is a perspective view illustrating an appearance of the key switch where a key top is removed.

As illustrated in FIG. 5, the key switch includes a key top 130, a pair of links 140*a* and 140*b* that cause an elevating operation of the key top 130 and a membrane switch 150 that switches on and off a contact point with an electric circuit in accordance with the elevating operation of the key top 130. The membrane switch 150 is provided on a support plate 160. The pair of links 140*a* and 140*b* are attached to the support plate 160 by a frame-shaped housing 170, and the membrane switch 150 is provided between the support plate 160 and the pair of links 140*a* and 140*b*.

The key top 130 substantially has a rectangular shape in a planar view, and an upper surface 130*a* is an operation surface that is pressed and operated by a user. The housing 170 is a frame member having a rectangular outer shape provided with a circular opening at its inside. The pair of links 140*a* and 140*b* have the same shape, and engage with each other by a gear action at ends, and configure a "V" shape gear link which has a "V" shape in a side view when the key top 130 is at a risen position.

Contact points of the membrane switch 150 are provided below a center of the key top 130, and a rubber actuator 180 is provided between the key top 130 and the membrane switch 150. The rubber actuator 180 deforms in accordance with a lowering operation of the key top 130 to switch on the contact points of the membrane switch 150. The membrane switch 150 is provided with two openings 151 that penetrate the membrane switch 150 formed such that the rubber actuator 180 is sandwiched therebetween.

Four protrusions 171 of the housing 170 are respectively inserted in four through-holes 161 formed in the support plate 160 via the openings 151 of the membrane switch 150, and adhered by an adhesive agent or the like. The rubber actuator 180 is provided inside a frame of the housing 170.

In this embodiment, the key top 130, the housing 170 and the links 140*a* and 140*b* may be formed as an integral molding product made of a resin material such as acrylonitrile butadiene styrene (ABS), for example. The membrane switch 150 is made of a resin material such as polyethylene terephthalate (PET), for example. The rubber actuator 180 may be made of an elastic resin material such as rubber, for example.

Two bearings 173 are formed at a lower portion of each of two facing side portions 172 of the frame of the housing 170. In this embodiment, each of the bearings 173 penetrate the respective side portion 172 of the housing 170 in a lateral direction, and four of the bearings 173 are provided in the housing 170.

Figure 7:
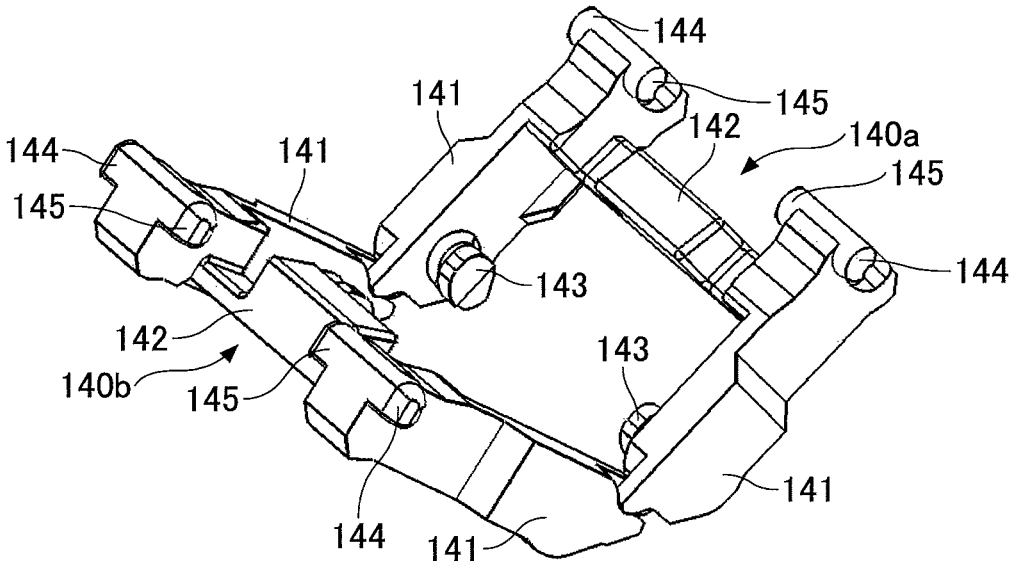
FIG. 7 perspective view of the links of the first embodiment.

As illustrated in FIG. 7, each of the links 140*a* and 140*b* includes two arms 141 that extend in a same direction in parallel, and a connection portion 142 that connects the two arms 141. Rotatable shafts 143 are formed at inner surfaces of the two arms 141 facing with each other of each of the links 140*a* and 140*b*, respectively, at one end portion of each of the two arms 141. Each of the rotatable shafts 143 is formed to be in parallel with the connection portion 142, and has a cylindrical shape. The rotatable shafts 143 provided at the two arms 141 of the same link 140*a* or 140*b* and facing with each other are formed to be coaxial. The rotatable shaft 143 is rotatably provided in the respective bearing 173 of the housing 170.

Among the two arms 141 of each of the link 140*a* and 140*b*, a first tooth 146 is formed at an end portion of one of the arms 141, and a second tooth 147 is formed at an end portion of the other of the arms 141. The first tooth 146 and the second tooth 147 of one of the links 140*a* and 140*b* respectively engage with the second tooth 147 and the first tooth 146 of the other of the links 140*a* and 140*b*.

First shafts 144 that protrude outwardly and second shafts 145 that protrude inwardly are formed at the two arms 141 of each of the links 140*a* and 140*b*, respectively, at the other end portion of the each of the arms 141 at a base end side. The two second shafts 145 formed at the two arms 141 of the same link 140*a* or 140*b* are facing with each other. Each of the first shafts 144 and the second shafts 145 is formed to be in parallel with the connection portion 142, and has a cylindrical shape. The first shafts 144 and the second shafts 145 provided at the two arms 141 of the same link 140*a* or 140*b* are formed to be coaxial.

Figure 8:
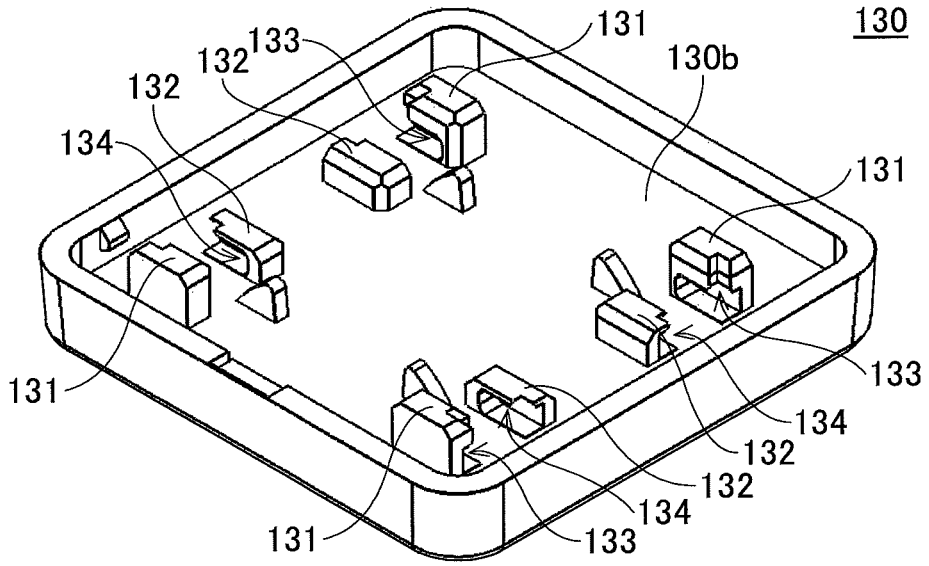
FIG. 8 is a perspective view of a key top of the first embodiment.
Figure 9:
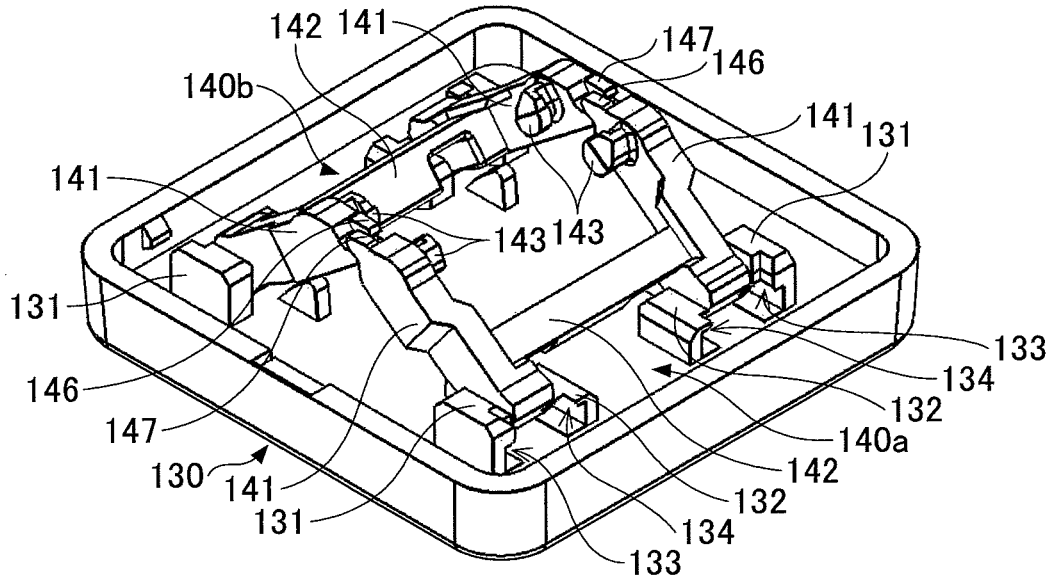
FIG. 9 a perspective view in which the links are attached to the key top of the first embodiment.
Figure 10:
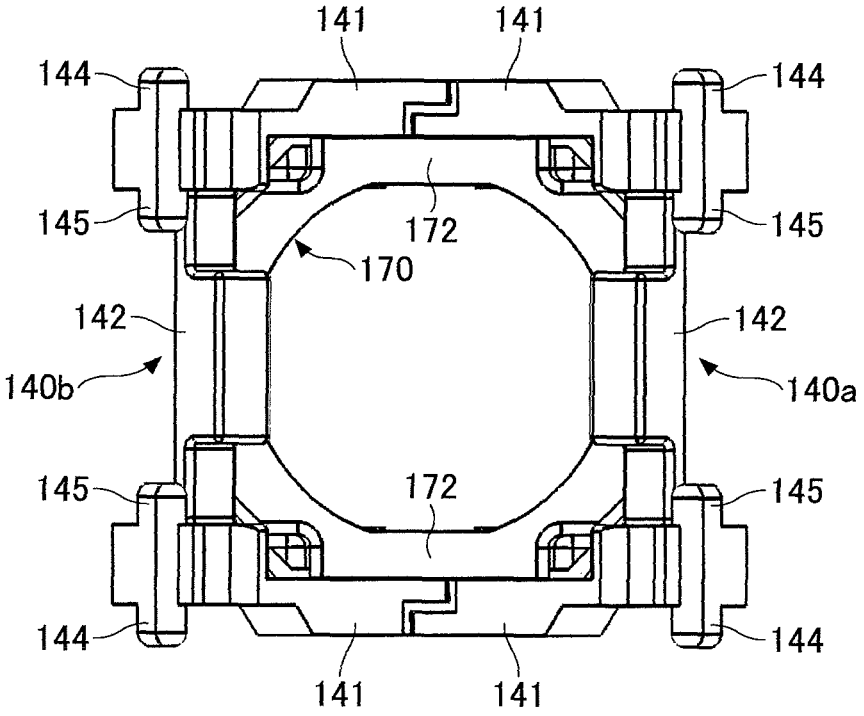
FIG. 10 is a plan view in which a housing is attached to the key top of the first embodiment.

FIG. 8 is a perspective view illustrating a lower surface 130*b* of the key top 130 of the embodiment. FIG. 9 is a perspective view illustrating a state in which the links 140*a* and 140*b* are attached to the key top 130. FIG. 10 is a plan view illustrating a state in which the housing 170 is attached to the key top 130.

In this embodiment, as illustrated in FIG. 8, first support portions 131 are provided at outside, and second support portions 132 are provided at inside, near four corners at the lower surface 130*b* of the key top 130, respectively. A first guide groove 133 is formed in each of the first support portions 131, and a second guide groove 134 is formed in each of the second support portions 132. The first guide groove 133 and the second guide groove 134 corresponding to each other are facing with each other.

As illustrated in FIG. 9, each of the first shafts 144 of the links 140*a* and 140*b* is slidably provided in the first guide groove 133 of the respective first support portion 131. Similarly, each of the second shafts 145 of the links 140*a* and 140*b* is slidably provided in the second guide groove 134 of the respective second support portion 132.

In such a key switch, data is input when the key top 130 is pressed. When the key top 130 is not pressed, the key top 130 is supported by a top portion of the rubber actuator 180, and the key top 130 is positioned furthest from the membrane switch 150 and the membrane switch 150 is at an off-state. Under this state, each of the first shafts 144 is positioned in the respective first guide groove 133, and each of the second shafts 145 is positioned in the respective second guide groove 134. Under the state of FIG. 9, an angle formed by the arms 141 of the links 140*a* and 140*b* becomes the minimum, in a side view.

When the key top 130 is pressed by a user under this state, each of the links 140*a* and 140*b* is rotated around the rotatable shafts 143, facing with each other, as a center by a lowering operation of the key top 130, the first shafts 144 slide in the first guide grooves 133, and the second shafts 145 slide in the second guide grooves 134, respectively, in each of the links 140*a* and 140*b*. With this, the rubber actuator 180 deforms. When the key top 130 is pressed to a predetermined position from the upper surface of the membrane switch 150, a protrusion provided inside the rubber actuator 180 presses the membrane switch 150, and the contact points of the membrane switch 150 contact with each other. With this, the membrane switch 150 becomes an on-state. At the on-state, an angle formed by the arms 141 of the links 140*a* and 140*b* becomes large compared with that at the off-state, in a side view.

When a finger of the user is released from the upper surface 130*a* of the key top 130, force pressing the key top 130 is removed, the key top 130 is pushed upward by the elasticity of the rubber actuator 180, and the membrane switch 150 is released from the key top 130 to become the off-state. At this time, each of the links 140*a* and 140*b* is rotated around the facing rotatable shafts 143, as a center, the first shafts 144 slide inwardly in the first guide grooves 133, and the second shafts 145 slide inwardly in the second guide grooves 134, respectively.

Figure 11A:
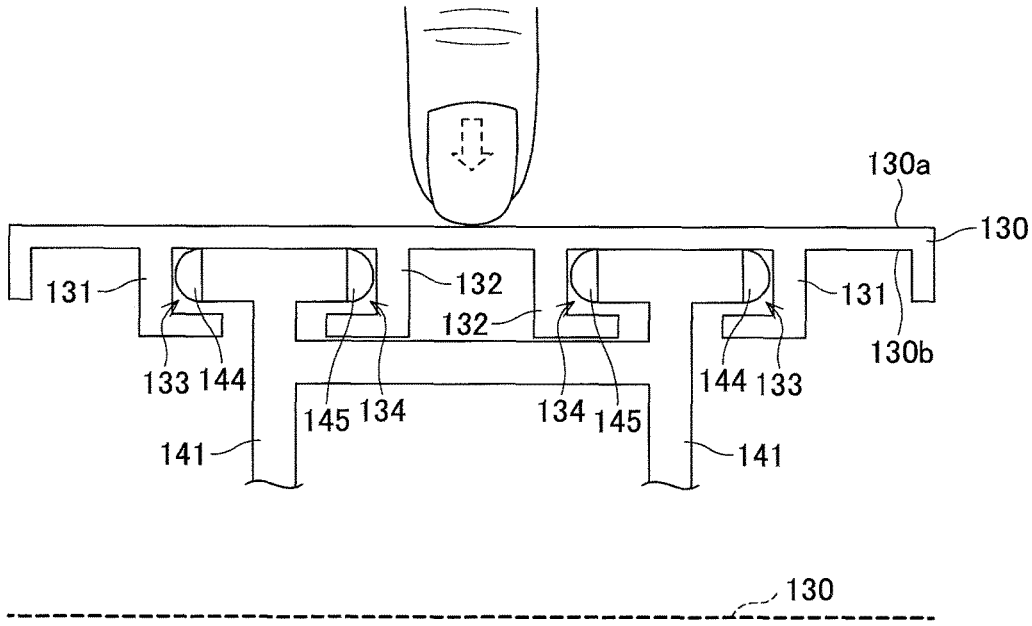
FIG. 11A and FIG. 11B are cross-sectional views of the key switch of the first embodiment.
Figure 11B:
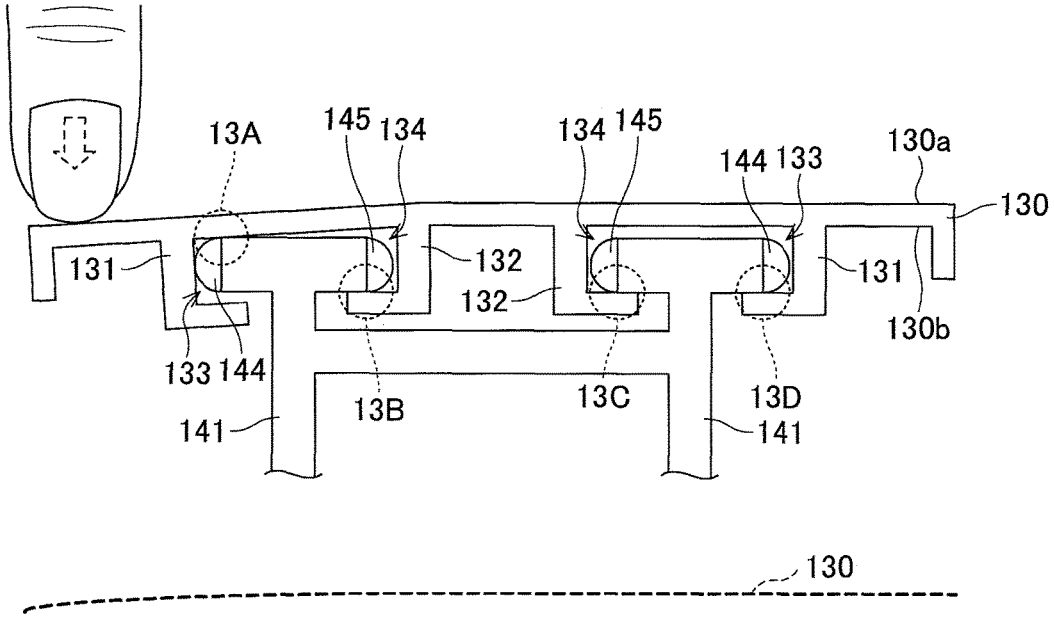

Although the key top 130 is made thin in the key switch of the embodiment, as illustrated in FIG. 11B, even when a portion near an edge of the key top 130 is pressed, deflection of the key top 130 is extremely small. As illustrated in FIG. 11A, when a center of the key top 130 is pressed, the key top 130 is not deflected almost at all.

As illustrated in FIG. 11B, when a left edge of the key top 130 is pressed, an upper portion of the first shaft 144 and the lower surface 130*b* of the key top 130 at left surrounded by a broken line circle 13A contact, and a lower portion of the second shaft 145 and a lower portion of the second guide groove 134 at left surrounded by a broken line circle 13B contact. Meanwhile, a lower portion of the second shaft 145 and a lower portion of the second guide groove 134 at right surrounded by a broken line circle 13C contact, and a lower portion of the first shaft 144 and a lower portion of the first guide groove 133 at right surrounded by a broken line circle 13D contact. Thus, even when the edge of the key top 130 is deflected, at the portion surrounded by the broken line circle 13B, the lower portion of the second shaft 145 and the lower portion of the second guide groove 134 contact. Therefore, deflection of the key top 130 at a right side from this position can be prevented. This is the same when a right edge of the key top 130 is pressed.

As such, according to the embodiment, as the key top 130 contacts each of the links 140*a* and 140*b* at four points by the first shafts 144 and the second shafts 145, compared with a case of FIG. 4B in which the key top 30 contacts each of the links 40*a* and 40*b* at two points, the number of contacting points is larger, and the center of the key top 130 is prevented from being curved and floated upward.

Thus, in this embodiment, as illustrated in FIG. 11B, even when an edge portion of the key top 130 is pressed, data can be input by a same stroke as a case of FIG. 11A in which the center of the key top 130 is pressed. Thus, lowering of usability can be prevented.

Figure 12:
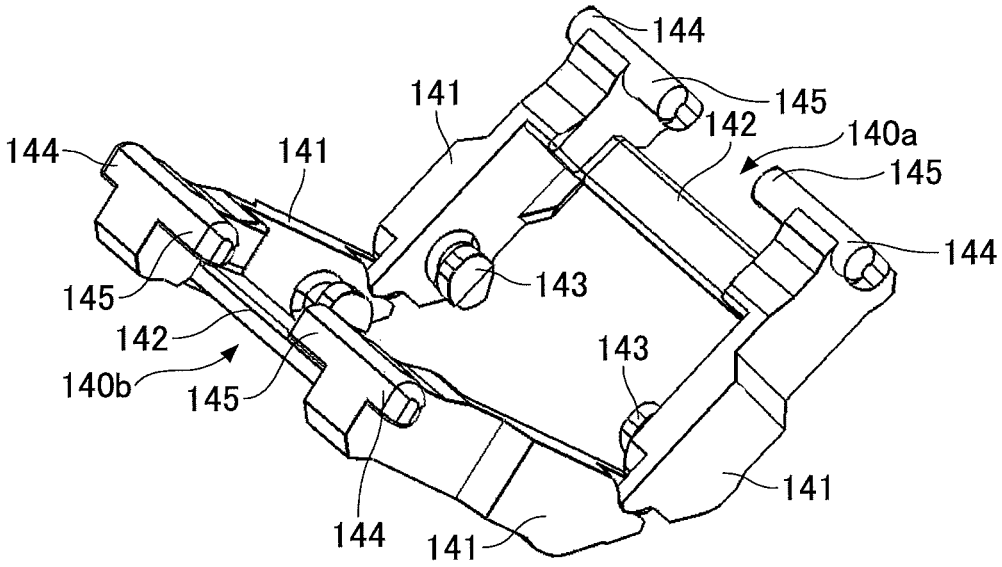
FIG. 12 is a perspective view illustrating links of an alternative example of the first embodiment.
Figure 13:
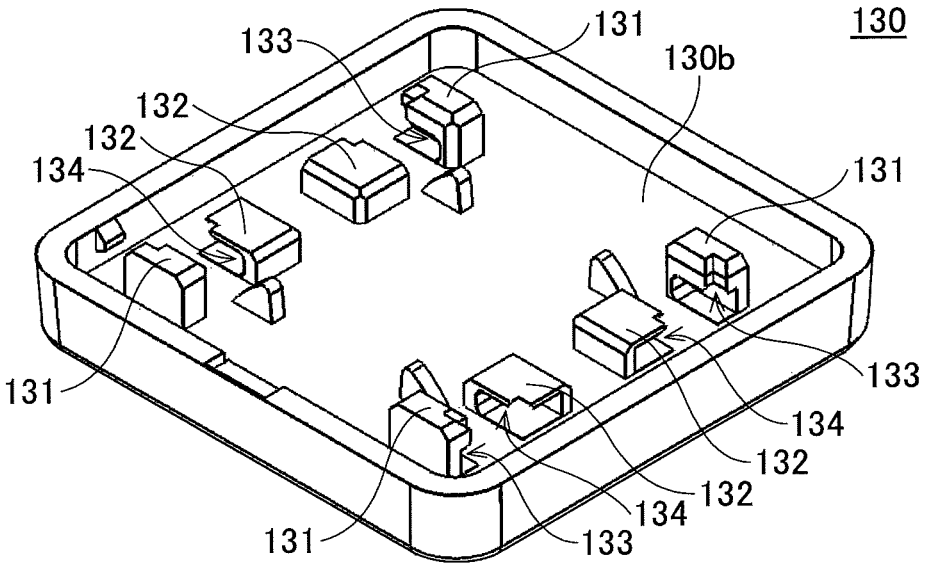
FIG. 13 is a perspective view illustrating a key top of an alternative example of the first embodiment.
Figure 14:
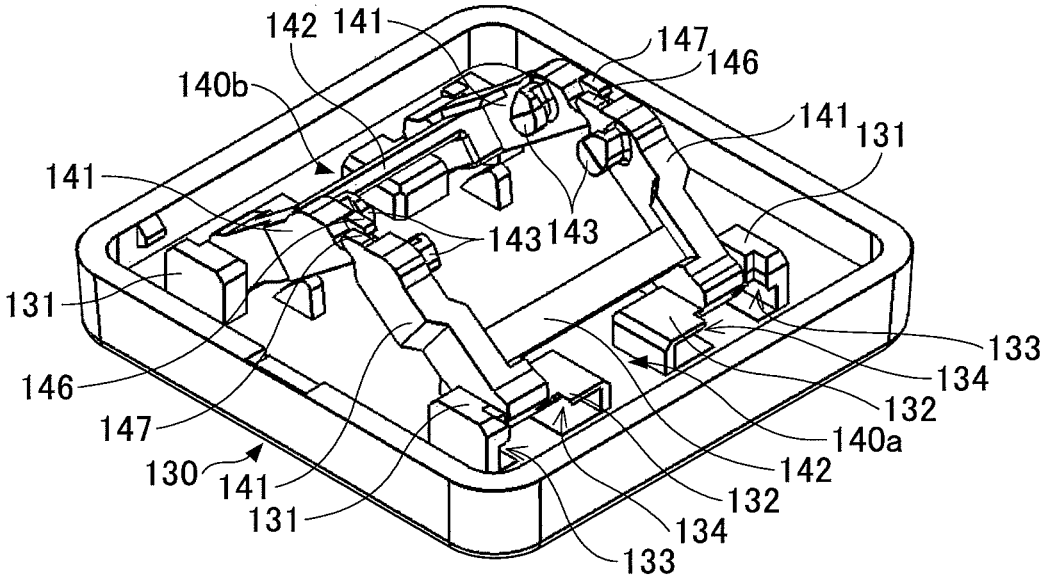
FIG. 14 a perspective view in which the links are attached to the key top of the alternative example of the first embodiment.

FIG. 12 is a perspective view illustrating another example of the links 140*a* and 140*b* of the first embodiment in each of which the second shafts 145 are longer than the first shafts 144, respectively. FIG. 13 is a perspective view illustrating the lower surface 130*b* of the key top 130 corresponding to the links 140*a* and 140*b* illustrated in FIG. 12. FIG. 14 is a perspective view in which the links 140*a* and 140*b* are attached to the key top 130.

As illustrated in FIG. 12 to FIG. 14, the length of each of the second shafts 145 may be longer than the length of each of the first shafts 144. With this, deflection of the center of the key top 130 can be furthermore reduced. In such a case, in accordance with elongating the second shaft 145, the second guide groove 134 is also formed to be deeper. It is preferable that the length of the second shaft 145 is greater than or equal to twice of the length of the first shaft 144. For example, the first shafts 144 and the second shafts 145 may be formed such that the length of each of the first shafts 144 is 1 mm, and the length of each of the second shafts 145 is 2 mm.

Second Embodiment

Figure 15:
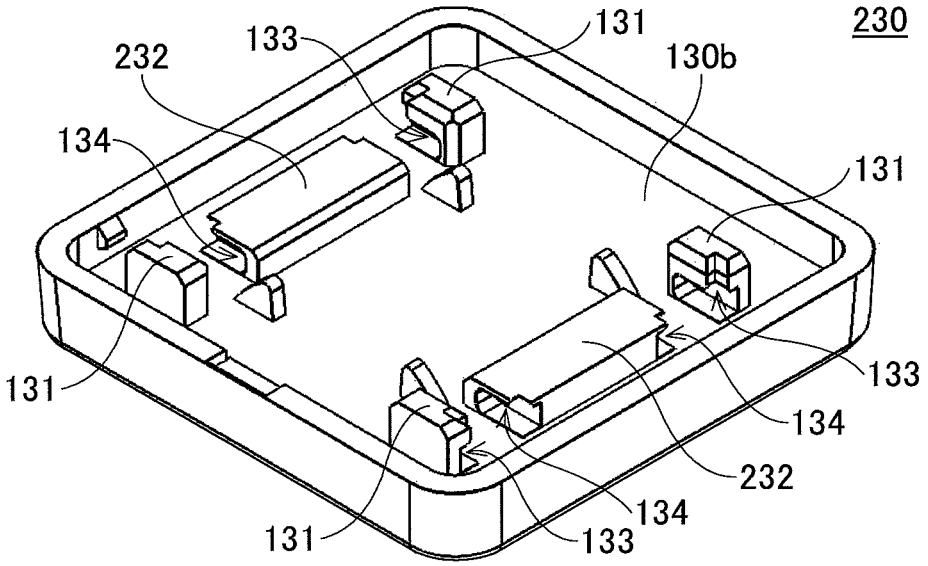
FIG. 15 is a perspective view of a key top of a second embodiment.
Figure 16:
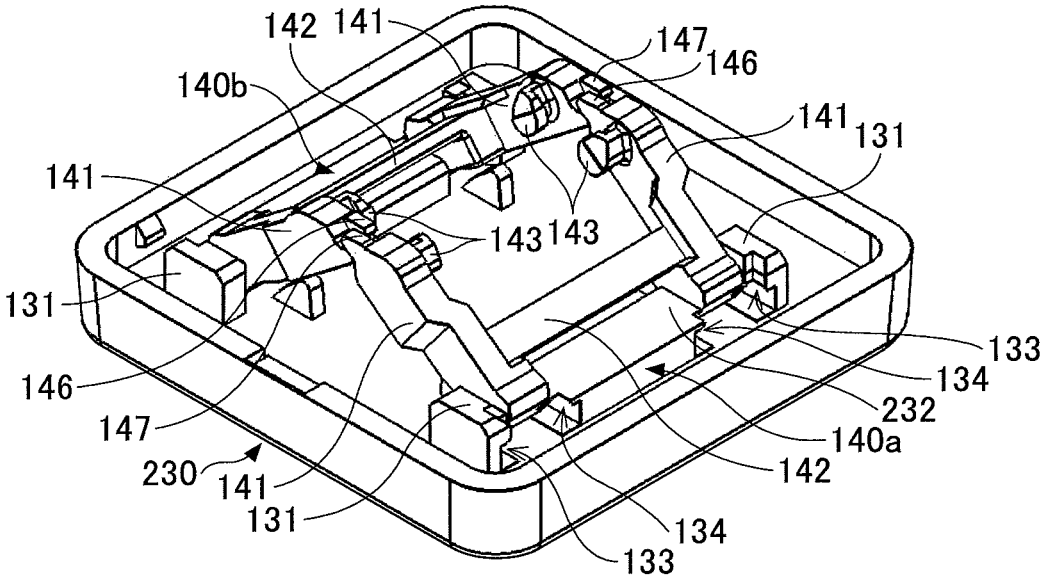
FIG. 16 a perspective view in which links are attached to the key top of the second embodiment.
Figure 17A:
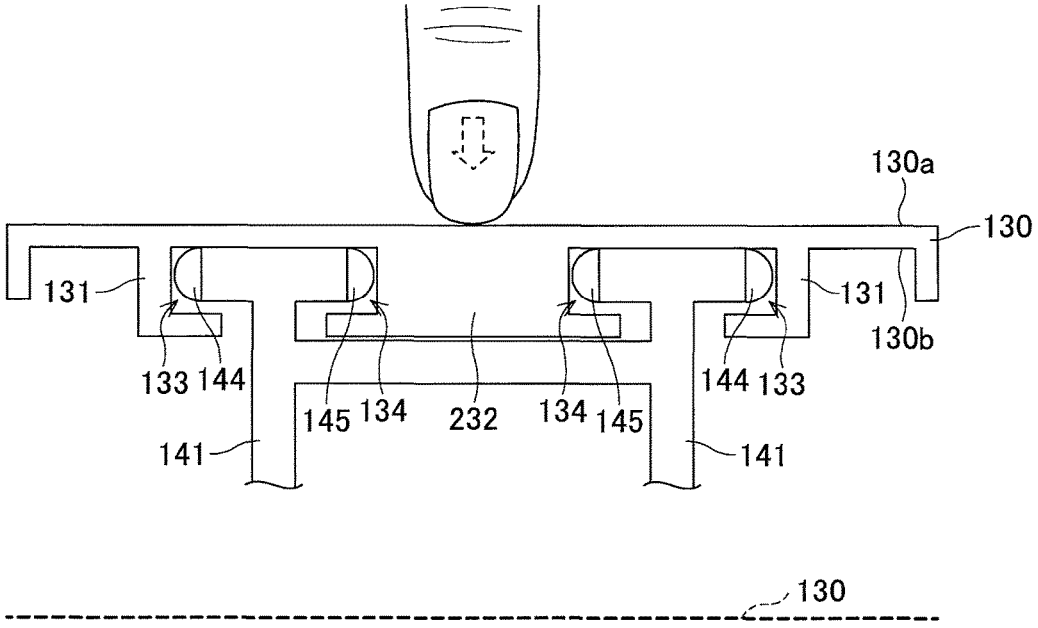
FIG. 17A and FIG. 17B are cross-sectional views of the key switch of the second embodiment.
Figure 17B:
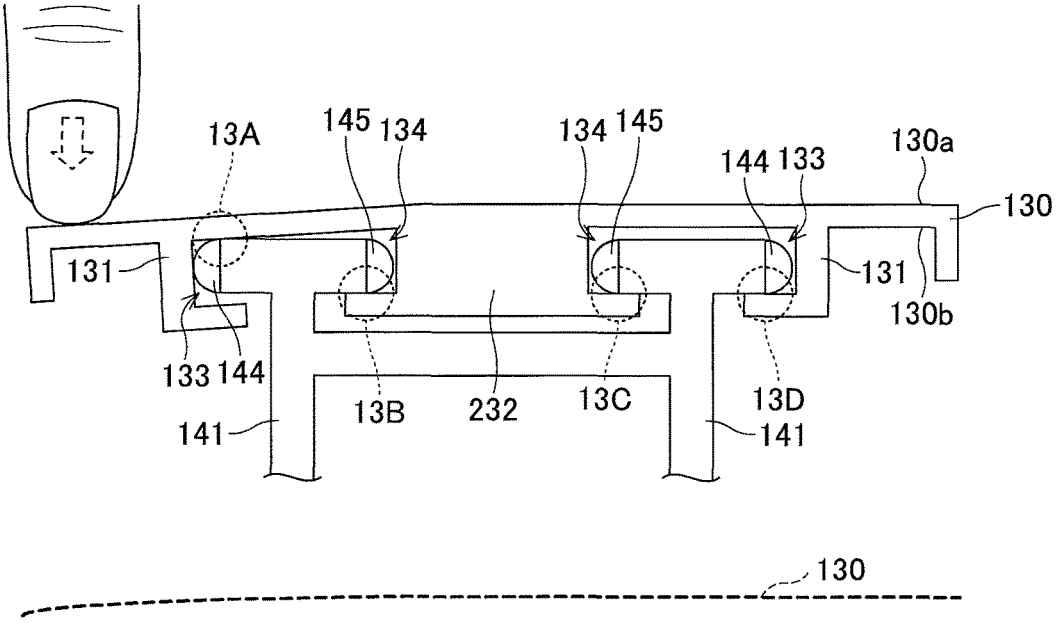

Second embodiment is described. FIG. 15 is a perspective view of a lower surface 130 of a key top 230 of the embodiment. FIG. 16 is a perspective view illustrating a state in which the pair of links 140*a* and 140*b* are attached to the key top 230. FIG. 17A is a view illustrating a state in which a center of the key top 230 is pressed, and FIG. 17B is a view illustrating a state in which an edge of the key top 230 is pressed. According to the second embodiment, instead of the two second support portions 132 of the key top 130 of the first embodiment, a second support portion 232 is provided for each of the links 140*a* and 140*b*. The second support portion 232 has a structure as if the two second support portions 132 of the key top 130 of the first embodiment are connected with each other.

The second support portions 232 are formed at the lower surface 130*b* of the key top 230. The second guide grooves 134 are provided at both sides of each of the second support portions 232, and each of the second guide grooves 134 is facing the respective first guide groove 133. By forming the second support portion 232 as if the two support portions are connected, the thickness of the key top 230 at an area where the second support portion 232 is formed becomes thick, and rigidity at the area is increased. Thus, deflection of the key top 230 can be furthermore reduced.

The second embodiment is the same as the first embodiment, except for the aspects of the second embodiment that are set forth above.

Third Embodiment

Figure 18:
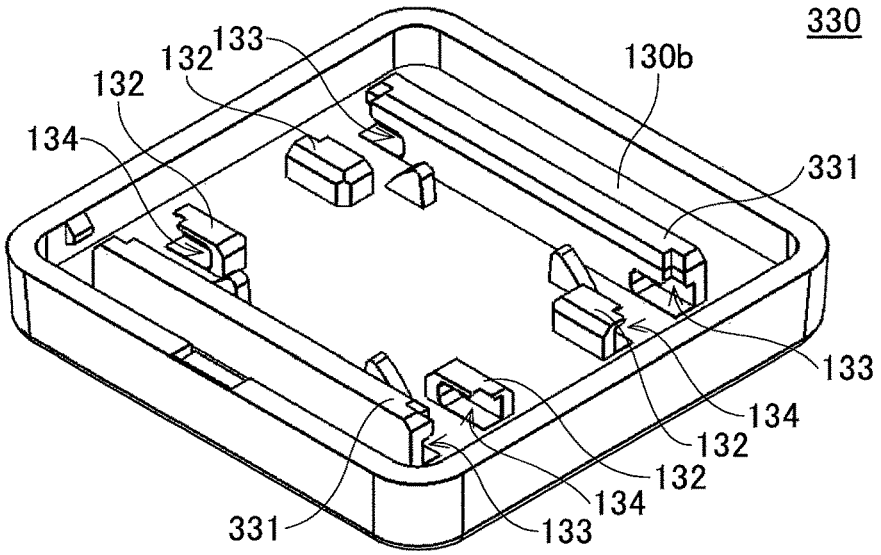
FIG. 18 is a perspective view of a key top of a third embodiment.
Figure 19:
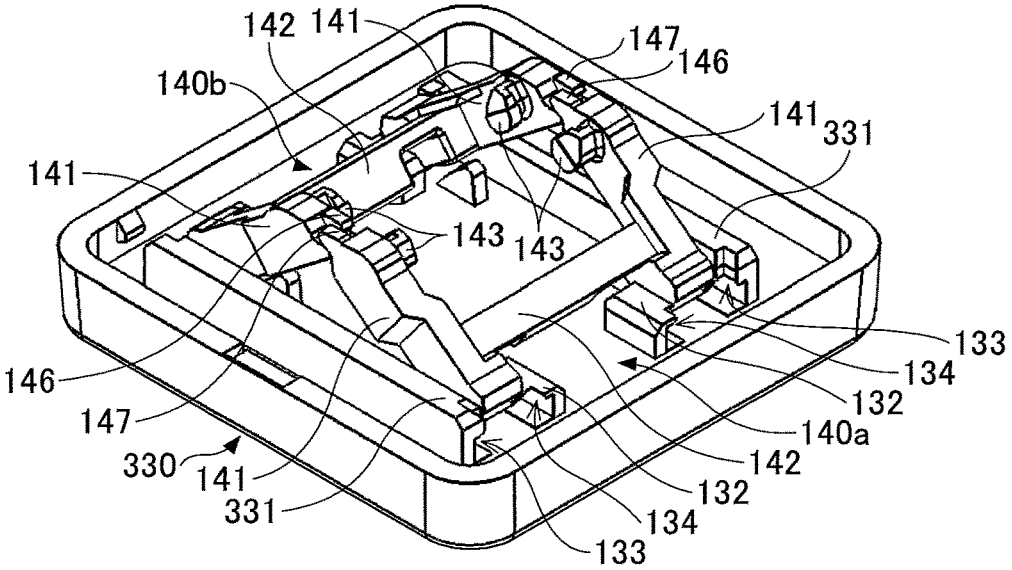
FIG. 19 a perspective view in which links are attached to the key top of the third embodiment.

Third embodiment is described. FIG. 18 is a perspective view of a lower surface 130*b* of a key top 330 of the embodiment. FIG. 19 is a perspective view illustrating a state in which the links 140*a* and 140*b* are attached to the key top 330. According to the third embodiment, instead of the two first support portions 131, provided at the same side for the links 140*a* and 140*b*, of the key top 130 of the first embodiment, a first support portion 331 is provided. The first support portion 331 has a structure as if the two first support portions 131 of the key top 130 of the first embodiment at the same side are connected with each other.

In the third embodiment, the first support portions 331 are formed at the lower surface 130*b* of the key top 330. The first support portion 331 is provided with the first guide grooves 133 at positions facing the respective second guide grooves 134. By forming such a first support portion 331, the thickness of the key top 330 at an area where the first support portion 331 is formed becomes thick, and rigidity at the area is increased. Thus, deflection of the key top 330 can be furthermore reduced.

Figure 20:
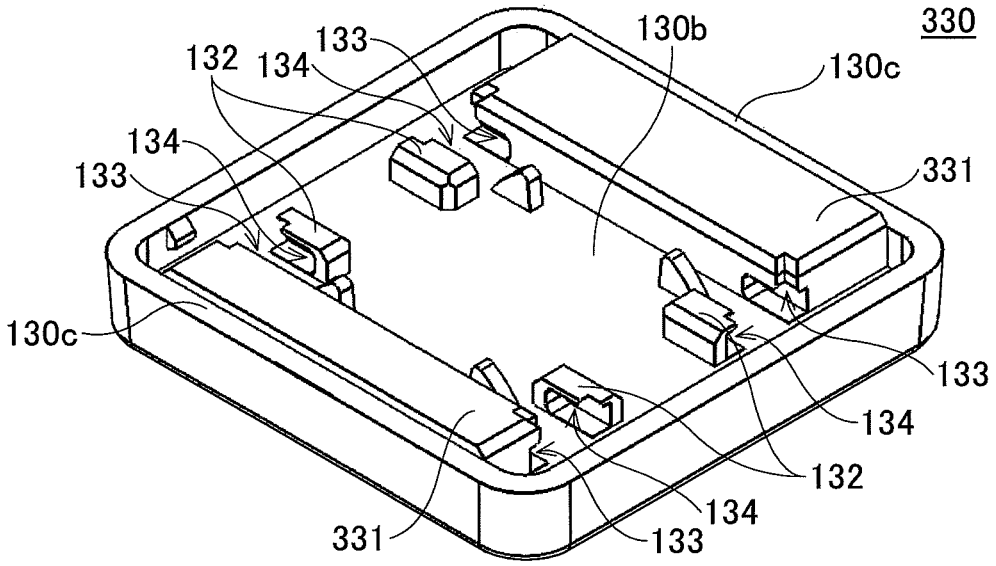
FIG. 20 is a perspective view illustrating a key top of an alternative example of the third embodiment.
Figure 21:
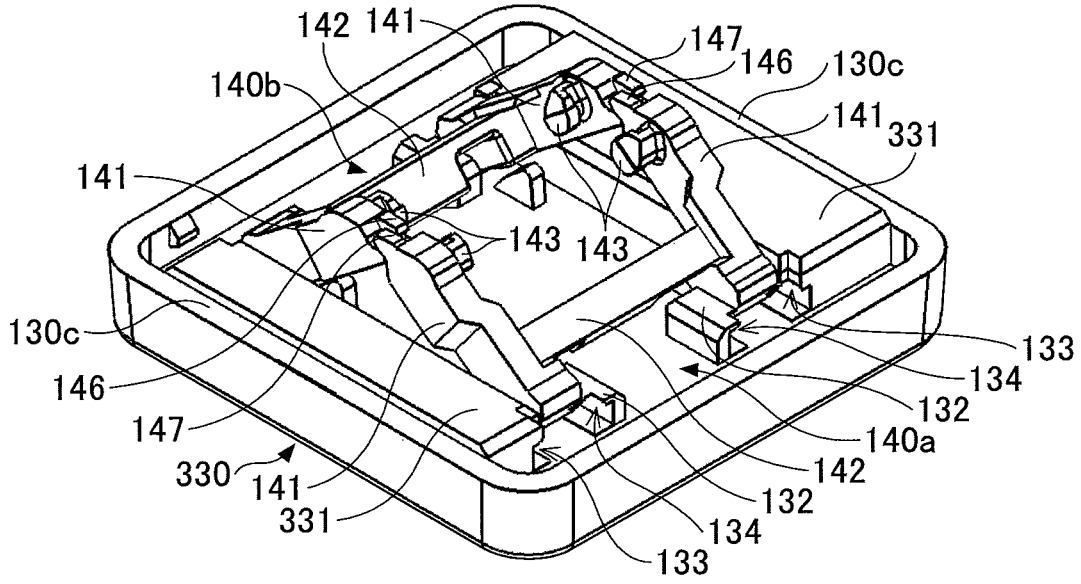
FIG. 21 is a perspective view in which links are attached to the key top of the alternative example of the third embodiment.
Figure 22A:
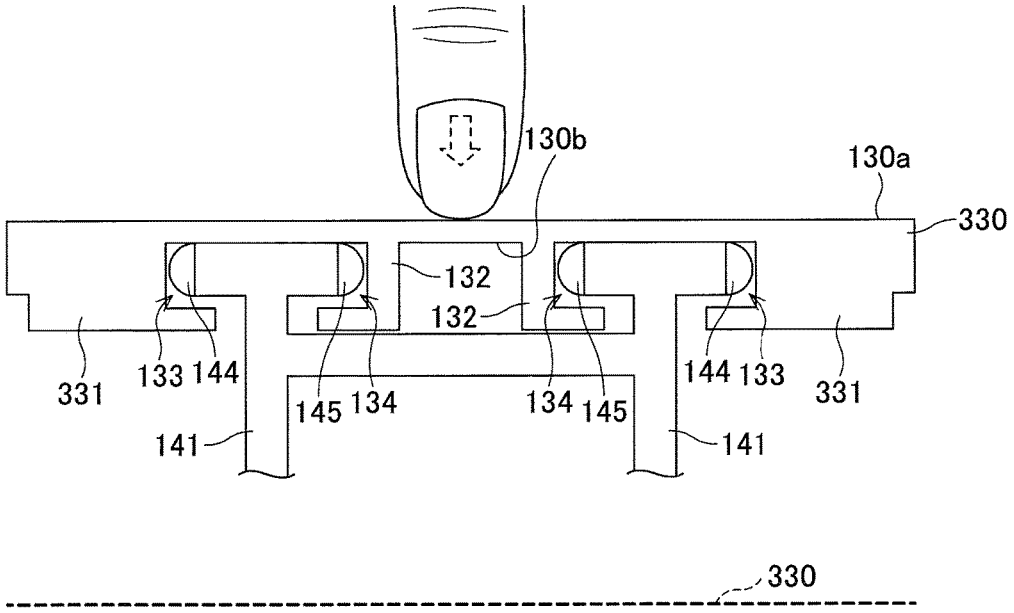
FIG. 22A and FIG. 22B are cross-sectional views illustrating the key switch of the alternative example of the third embodiment.
Figure 22B:
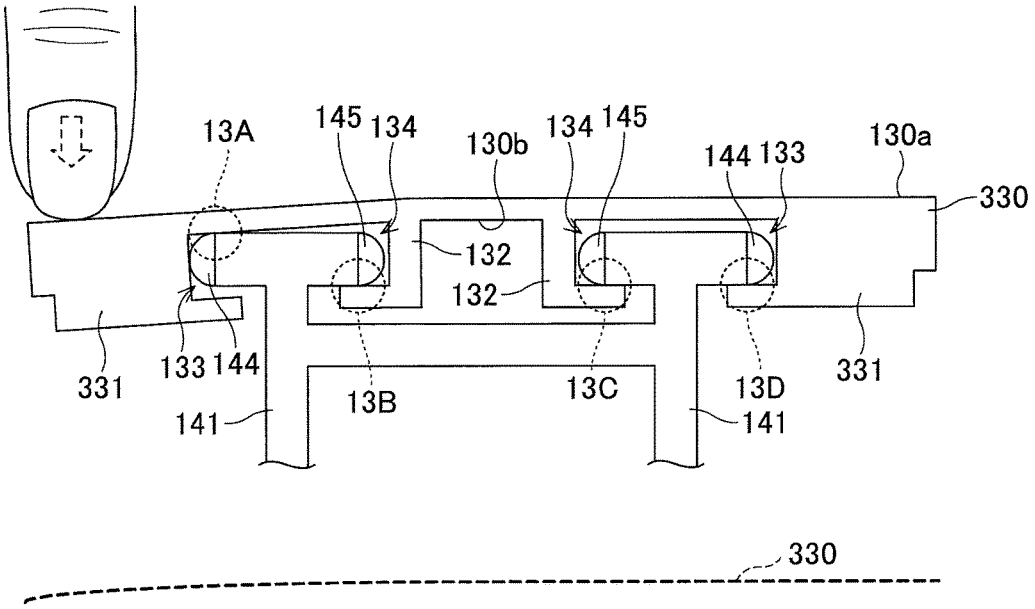

As illustrated in FIG. 20 to FIG. 22B, the key top 330 may be configured such that the first support portion 331 is further broadened to extend up to a side wall 130*c* of the key top 330. FIG. 20 is a perspective view illustrating the lower surface 130*b* of the key top 330 of an alternative example of the third embodiment. FIG. 21 is a perspective view illustrating a state in which the pair of links 140*a* and 140*b* are attached to the key top 330. FIG. 22A is a view illustrating a state in which a center of the key top 330 is pressed, and FIG. 22B is a view illustrating a state in which an edge of the key top 330 is pressed. By forming the first support portion 331 to extend up to the side wall 130*c*, rigidity of the key top 330 can be furthermore increased and deflection can be reduced.

The third embodiment is the same as the first embodiment, except for the aspects of the second embodiment that are set forth above.

Fourth Embodiment

Figure 23:
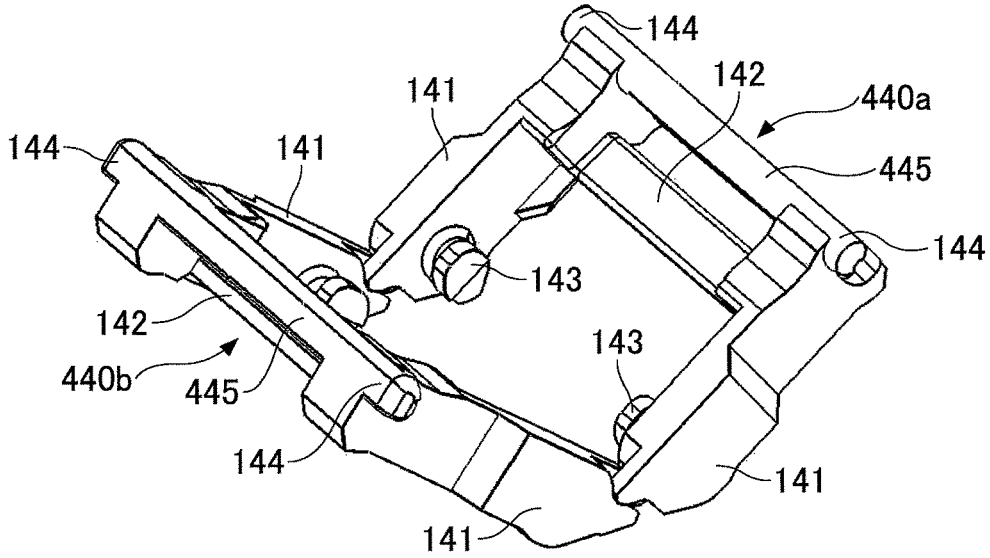
FIG. 23 is a perspective view of links of a fourth embodiment.
Figure 24:
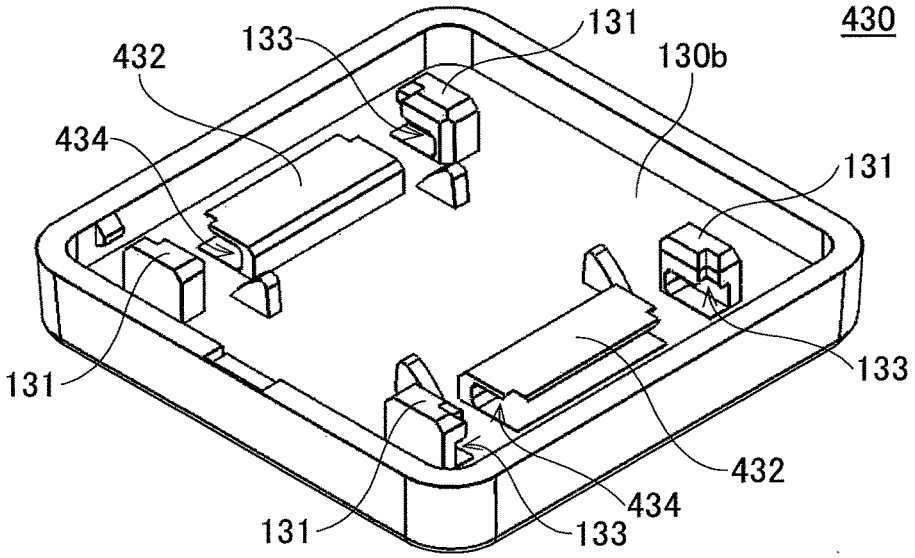
FIG. 24 is a perspective view of a key top of the fourth embodiment.
Figure 25:
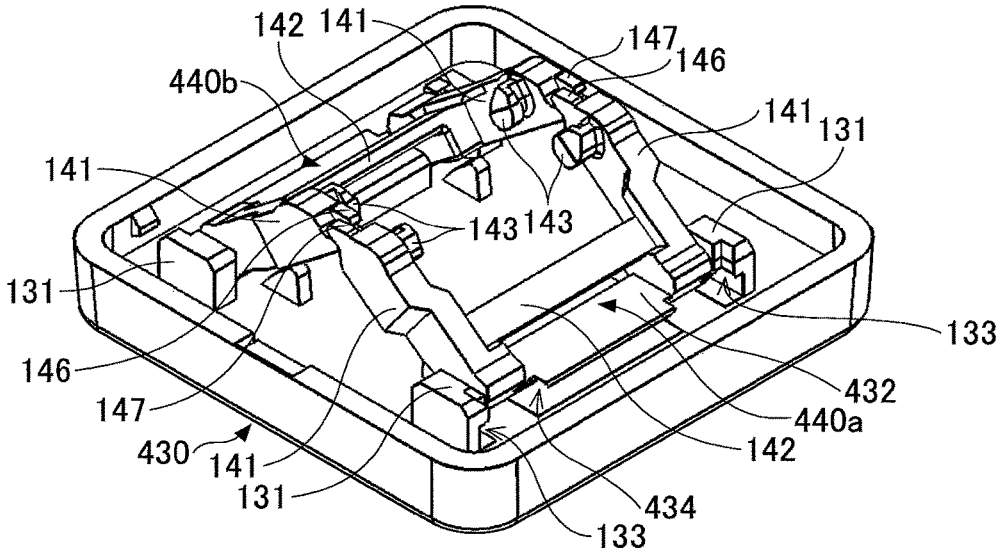
FIG. 25 a perspective view in which the links are attached to the key top of the fourth embodiment.

Fourth embodiment is described. FIG. 23 is a perspective view illustrating links 440*a* and 440*b* of the embodiment. FIG. 24 is a perspective view illustrating a lower surface 130*b* of a key top 430 of the embodiment. FIG. 25 is a perspective view illustrating a state in which the links 440*a* and 440*b* are attached to the key top 430. According to the fourth embodiment, instead of the two second shafts 145 of each of the links 140*a* and 140*b* of the first embodiment, a second shaft 445 is provided for each of the links 440*a* and 440*b*. The second shaft 445 has a structure as if the two second shafts 145 of each of the links 140*a* and 140*b* of the first embodiment are connected with each other.

In this embodiment, the second shaft 445 that connects the two arms 141 facing with each other is provided in each of the links 440*a* and 440*b*.

Furthermore, corresponding to the shape of the second shaft 445, instead of the two second support portions 132 of the key top 130 of the first embodiment, a second support portion 432 is provided for each of the links 440*a* and 440*b*. The second support portion 432 has a structure as if the two second support portions 132 of the key top 130 of the first embodiment are connected with each other. Furthermore, each of the second support portions 432 is provided with a second guide groove 434 that penetrates the second support portion 432 in which the respective second shaft 445 can be inserted.

Figure 26A:
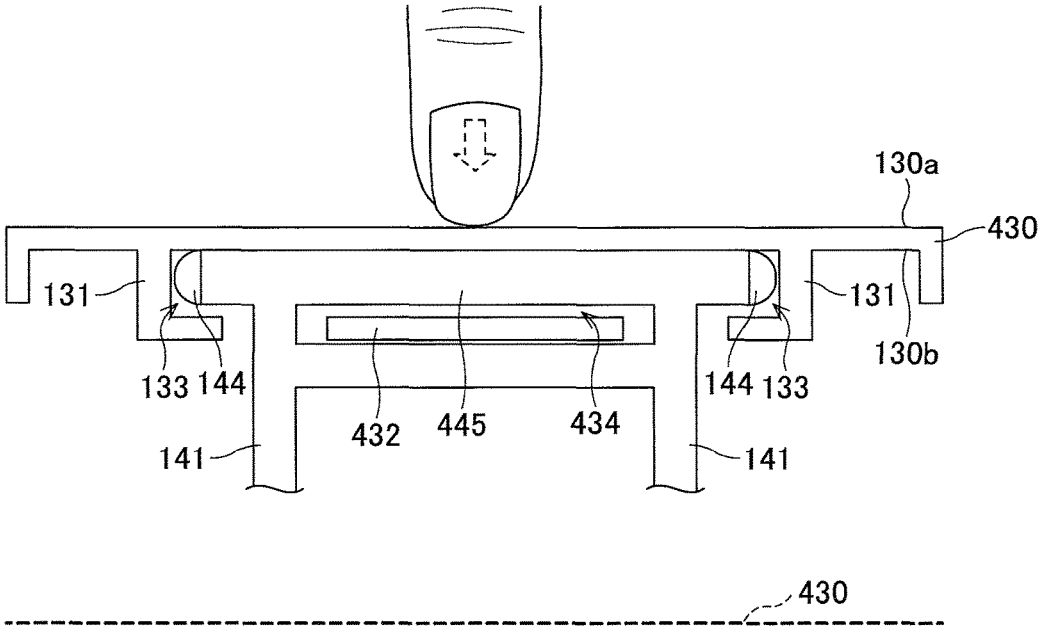
FIG. 26A and FIG. 26B are cross-sectional views of the key switch of the fourth embodiment.
Figure 26B:
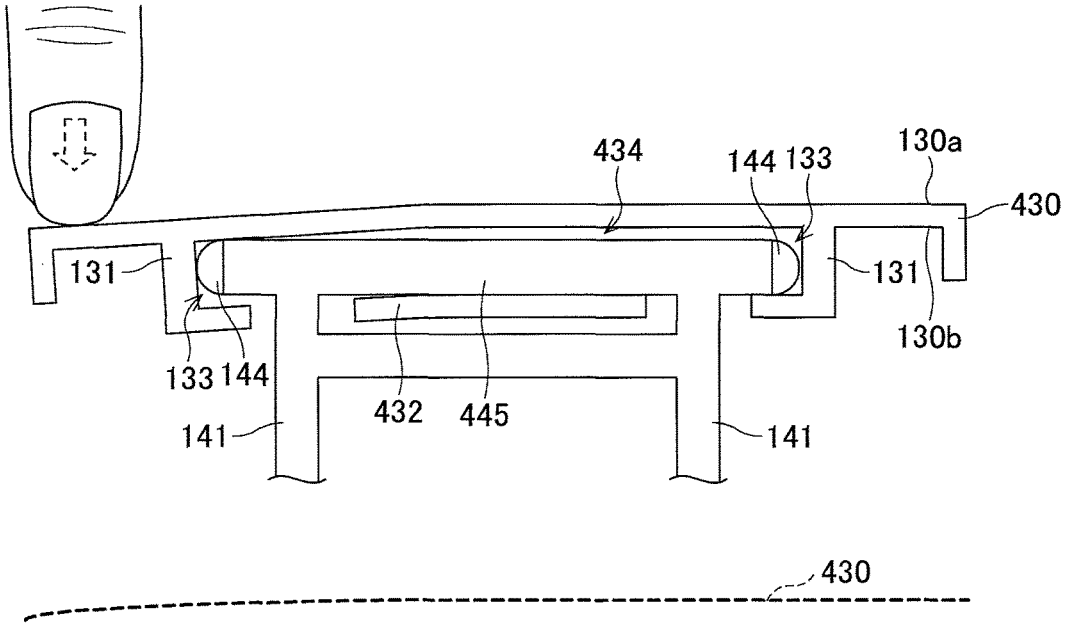

In this embodiment, as an area where each of the second support portions 432 is formed is wide, rigidity of the key top 430 can be increased. Further, as both ends of the second shaft 445 are respectively connected to the two arms 141 of each of the links 440*a* and 440*b*, as illustrated in FIG. 26B, even when an edge portion of the key top 430 is pressed, the key top 430 and each of the links 440*a* and 440*b* contact at a wide area, on a line, for example, at an upper portion of the second shaft 445 and an upper portion of the second guide groove 434, and at a lower portion of the second shaft 445 and a lower portion of the second guide groove 434. Thus, deflection of the key top 430 at a center can be furthermore prevented. With this, data can be input by a same stroke as a case of FIG. 26A in which the center of the key top 430 is pressed. Thus, lowering of usability can be prevented.

The fourth embodiment is the same as the first embodiment, except for the aspects of the second embodiment that are set forth above.

Fifth Embodiment

Figure 27:
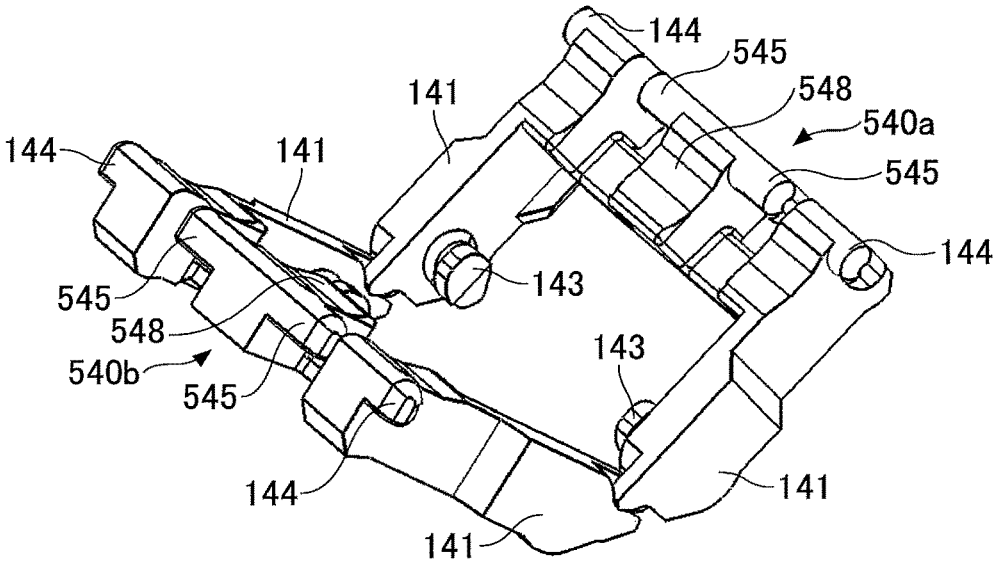
FIG. 27 is a perspective view of links of a fifth embodiment.
Figure 28:
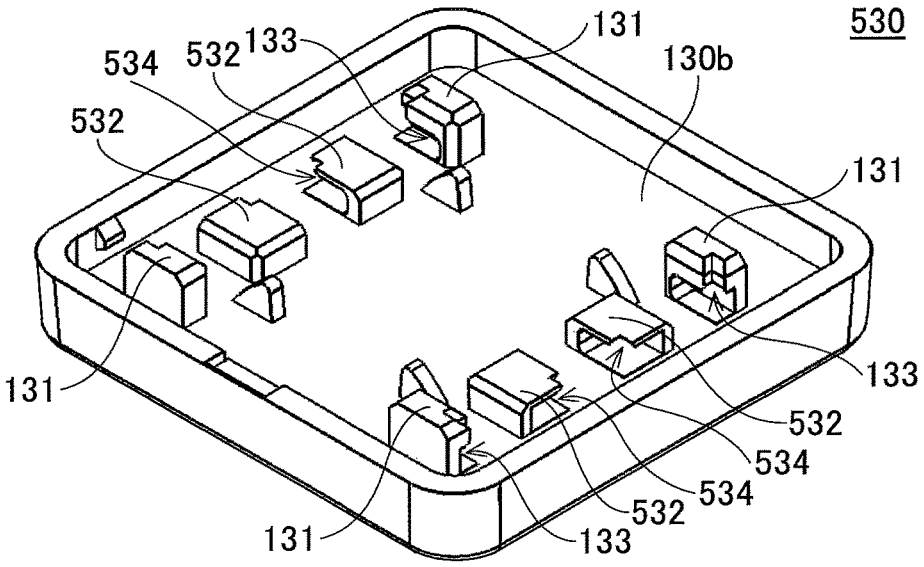
FIG. 28 is a perspective view of a key top of the fifth embodiment.
Figure 29:
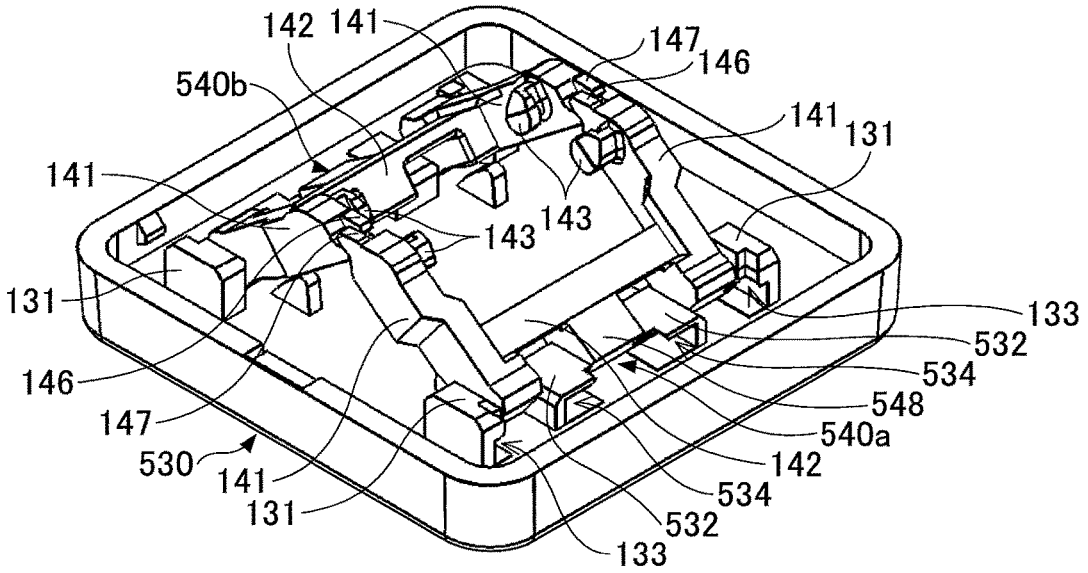
FIG. 29 is a perspective view in which the links are attached to the key top of the fifth embodiment.

Fifth embodiment is described. FIG. 27 is a perspective view illustrating links 540*a* and 540*b* of the embodiment. FIG. 28 is a perspective view illustrating a lower surface 130*b* of a key top 530 of the embodiment. FIG. 29 is a perspective view illustrating a state in which the links 540*a* and 540*b* are attached to the key top 530. According to the fifth embodiment, a center arm 548 is provided between the two arms 141 of each of the link 540*a* or 540*b*, and second shafts 545, which are coaxial, are provided at both sides of the center arm 548 at an end. In accordance with this configuration, the key top 530 includes four second support portions 532 provided at the lower surface 130*b* each being provided with a second guide groove 534 wherein two of the second guide grooves 534 are formed to be facing with each other at an inner side.

The key switch of the embodiment can obtain the same effects as those of the first embodiment.

The fifth embodiment is the same as the first embodiment, except for the aspects of the second embodiment that are set forth above.

Sixth Embodiment

Figure 30:
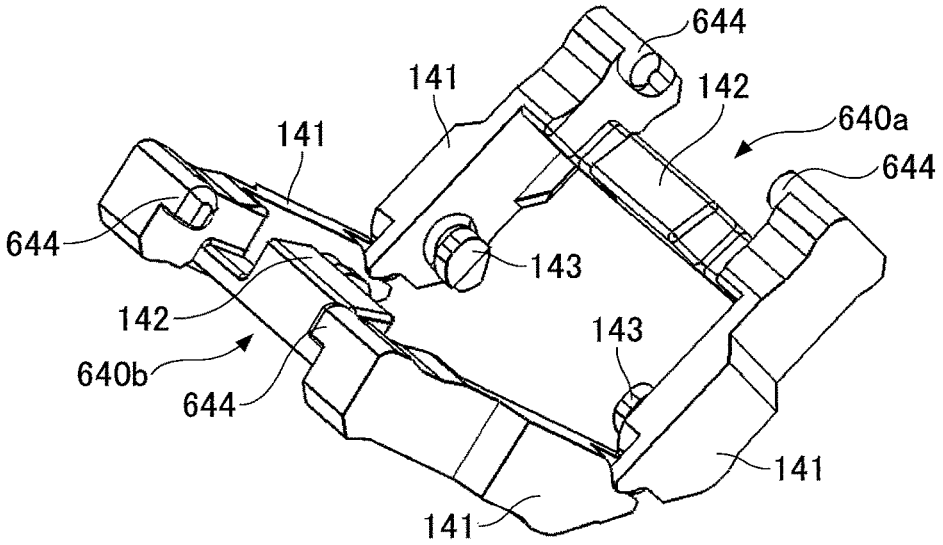
FIG. 30 is a perspective view of links of a sixth embodiment.
Figure 31A:
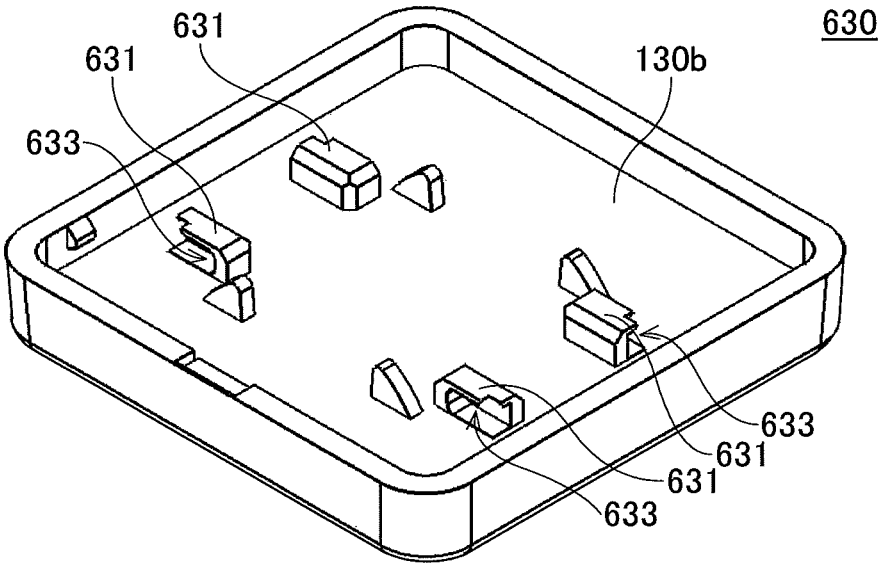
FIG. 31A and FIG. 31B are views for describing a key top of the sixth embodiment.
Figure 31B:
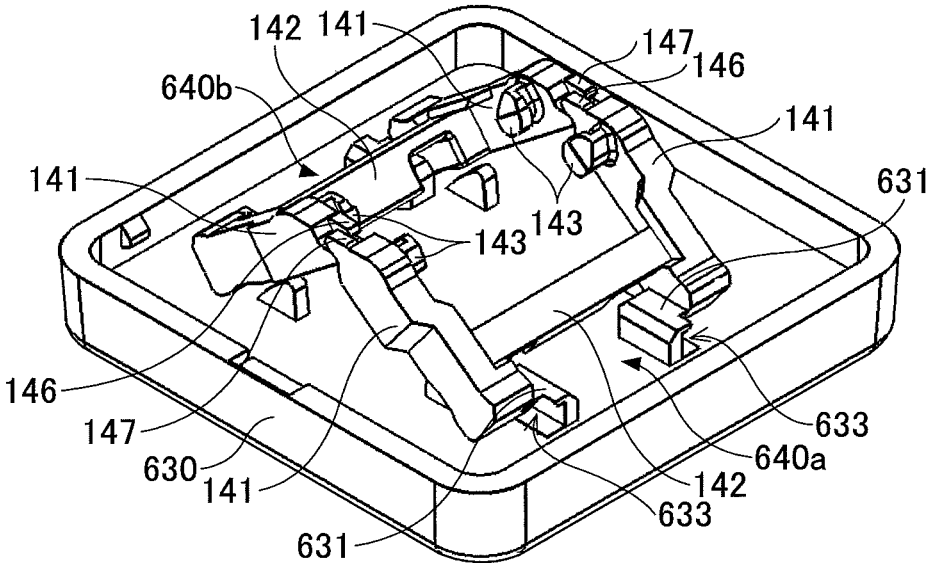

Sixth embodiment is described. FIG. 30 is a perspective view illustrating links 640*a* and 640*b* of the embodiment. FIG. 31A is a perspective view illustrating a lower surface 130*b* of a key top 630 of the embodiment. FIG. 31B is a perspective view illustrating a state in which the links 640*a* and 640*b* are attached to the key top 630. According to the sixth embodiment, a shaft 644 is provided at an inner surface of each of the two arms 141 of each of the links 640*a* and 640*b*. The two shafts 644 provided at each of the links 640*a* and 640*b* are facing with each other and are coaxial.

By providing the shaft 644 at the inner surfaces of the arms 141, each connection portion between the shaft 644 and the key top 630 is positioned at an inner side of the key top 630. Thus, even when an edge of the key top 630 is pressed, deflection at the center of the key top 630 becomes small. Thus, according to the embodiment as well, a same effect as that of the first embodiment can be obtained.

Support portions 631 in each of which a guide groove 633 corresponding to the shaft 644 is formed are provided at the lower surface 130*b* of the key top 630.

Figure 32A:
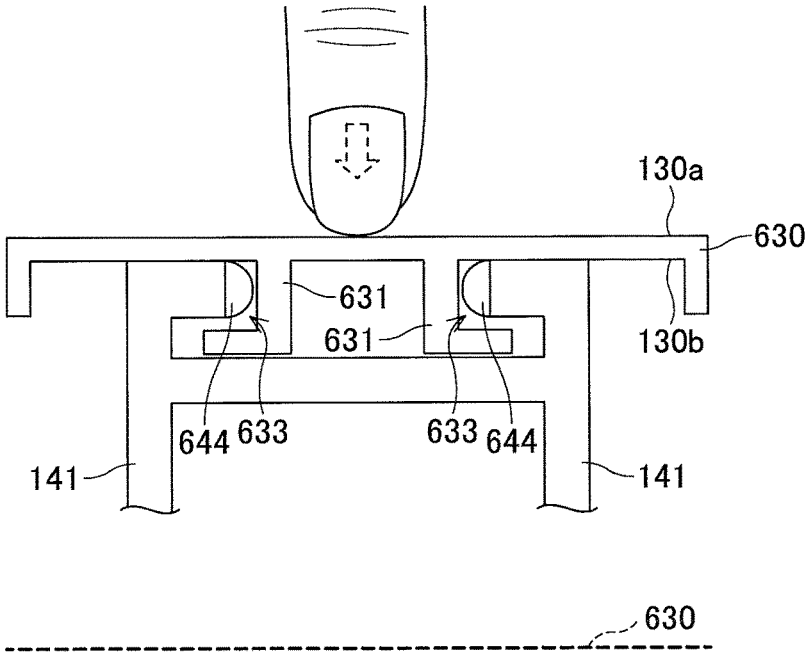
FIG. 32A and FIG. 32B are cross-sectional views of a key switch of the sixth embodiment.
Figure 32B:
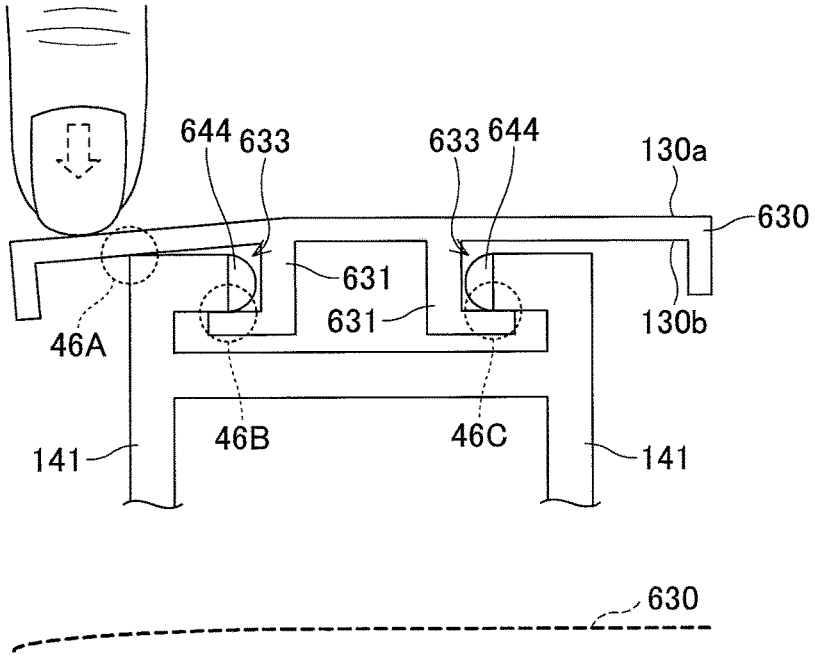

As illustrated in FIG. 32B, when a left edge of the key top 630 is pressed, a connection portion of the shaft 644 and the arm 141 and a lower surface of the key top 630 at left surrounded by a broken line circle 46A contact, a lower portion of the shaft 644 and a lower portion of the guide groove 633 of the key top 630 at left surrounded by a broken line circle 46B contact, and a lower portion of the shaft 644 and a lower portion of the guide groove 633 at right surrounded by a broken line 46C circle contact. Thus, the key top 630 and each of the links 640*a* and 640*b* contact at three points by the shafts 644. Thus, compared with a case of FIG. 4B in which the key top 30 contacts each of the links 40*a* and 40*b* at two points, the number of contacting points is larger, and the center of the key top 630 is prevented from being curved and floated upward. Here, FIG. 32A illustrates a state in which a center of the key top 630 is pressed.

Figure 33:
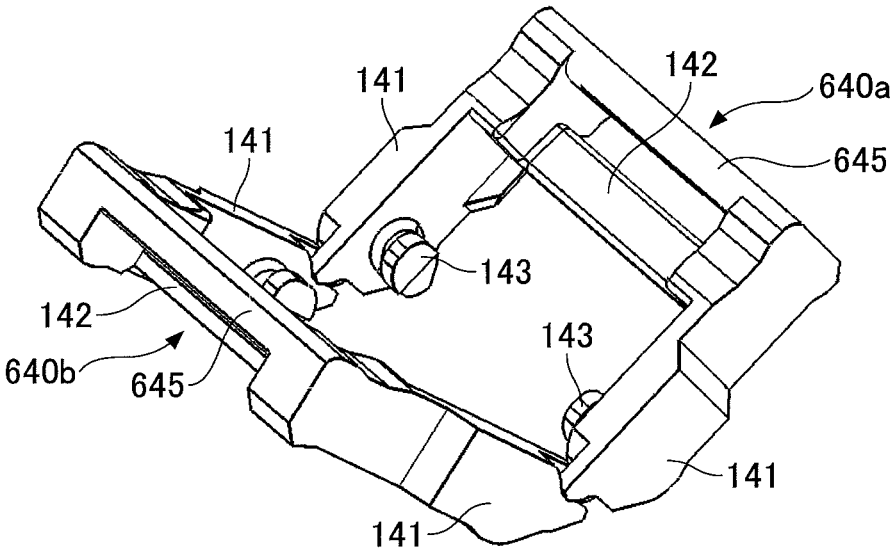
FIG. 33 is a perspective view illustrating links of an alternative example of the sixth embodiment.
Figure 34A:
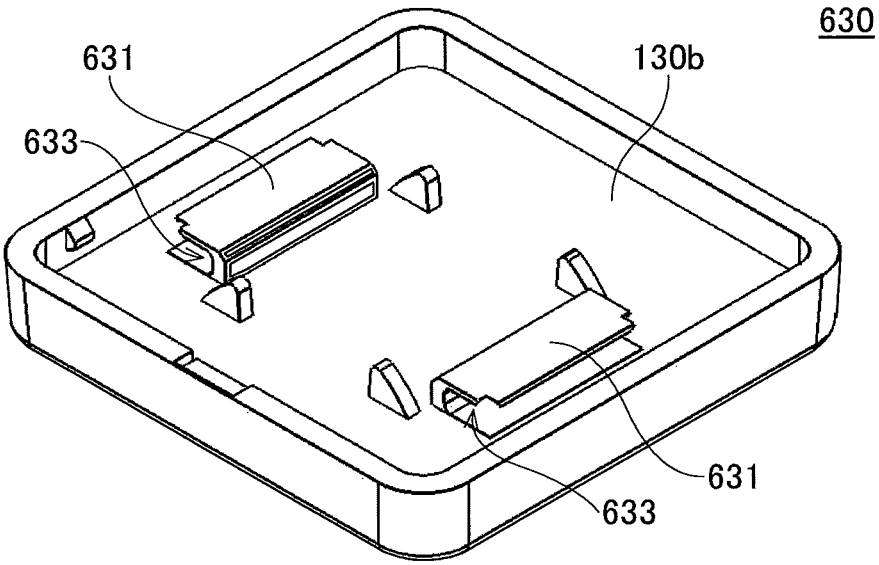
FIG. 34A and FIG. 34B are views for describing a key top of the alternative example of the sixth embodiment.
Figure 34B:
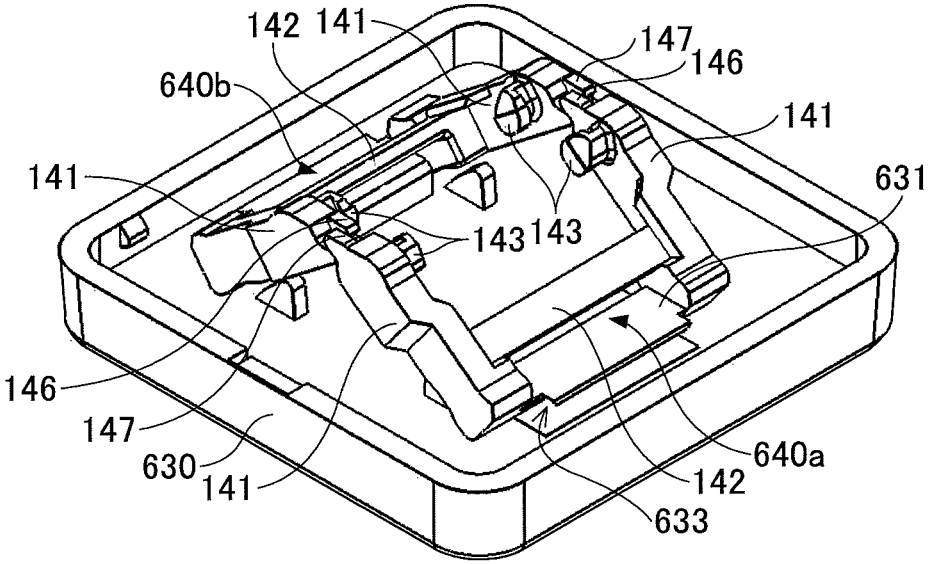

Further, as illustrated in FIG. 33 to FIG. 34B, a shaft 645 that connects inner surfaces of the arms 141 may be provided. FIG. 33 is a perspective view illustrating the links 640*a* and 640*b* of an alternative example of the embodiment. FIG. 34A is a perspective view illustrating a lower surface 130*b* of the key top 630. FIG. 34B is a perspective view illustrating a state in which the links 640*a* and 640*b* are attached to the key top 630.

Figure 35A:
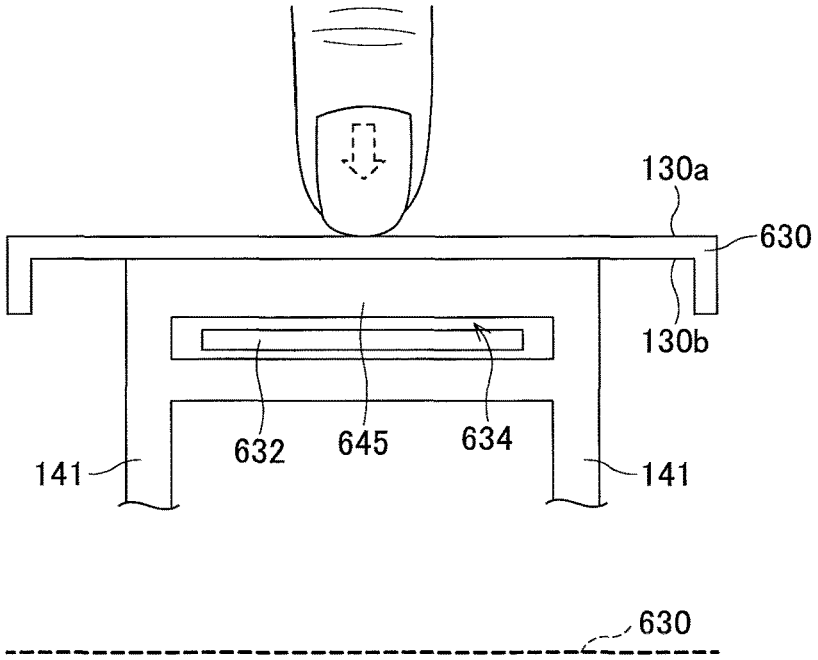
FIG. 35A and FIG. 35B are cross-sectional views illustrating a key switch of the alternative example of the sixth embodiment.
Figure 35B:
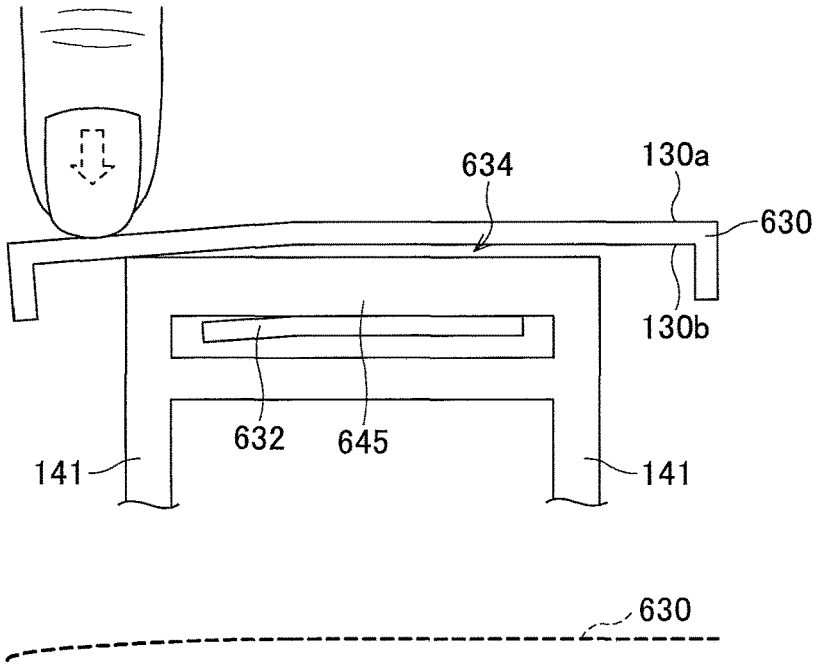

In such a case, as an area where each of the support portions 632 is formed is wide, rigidity of the key top 630 can be increase. Further, as both ends of the shaft 645 are respectively connected to the arms 141 of each of the links 640*a* and 640*b*, as illustrated in FIG. 35B, even when an edge portion of the key top 630 is pressed, the key top 630 and each of the links 640*a* and 640*b* contact at a wide area, on a line, for example, at an upper portion of the shaft 645 and an upper portion of the guide groove 634, and at a lower portion of the shaft 645 and a lower portion of the guide groove 634. Thus, deflection of the key top 630 can be furthermore prevented. FIG. 35A illustrates a state in which a center of the key top 630 is pressed. In such a case, the key top 630 is not deflected almost at all.

The sixth embodiment is the same as the first embodiment, except for the aspects of the second embodiment that are set forth above.

Seventh Embodiment

Seventh embodiment is described. In this embodiment, a keyboard using the key switch of one of the first to sixth embodiments is described. The keyboard of the embodiment is described with reference to FIG. 36A and FIG. 36B.

Figure 36A:
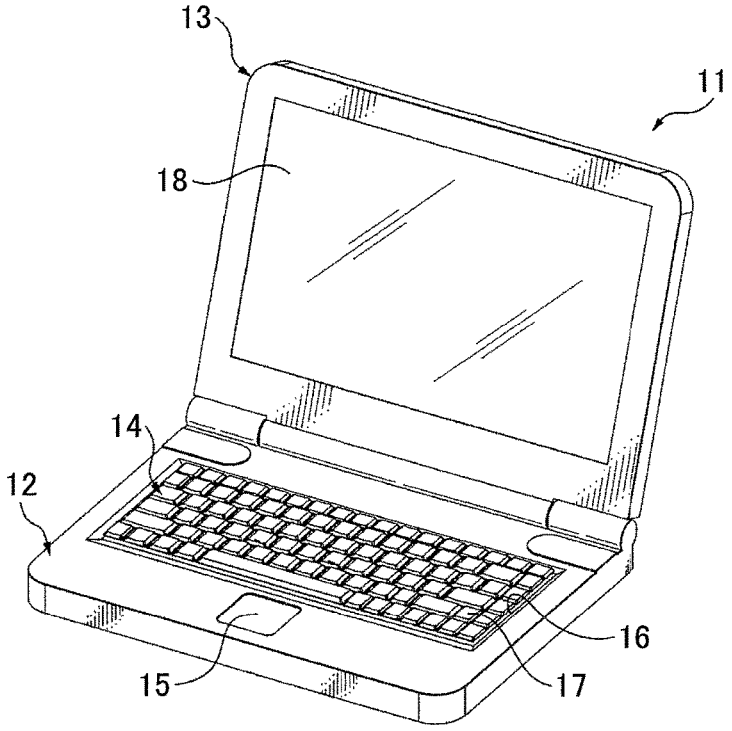
FIG. 36A and FIG. 36B are views for describing an electronic device of a seventh embodiment on which a keyboard is mounted.

FIG. 36A is a perspective view illustrating an appearance of a notebook personal computer (hereinafter, referred to as a "notebook PC") 11 as an example of the electronic device. The notebook PC 11 includes a thin main housing 12 and a housing 13 for a display that is connected to the main housing 12 capable of being opened and closed with respect to the main housing 12. Input devices such as a keyboard 14 and a pointing device 15 are mounted at a surface of the main housing 12. The keyboard 14 is fitted in an opening 16 of the main housing 12, for example, and includes a plurality of key switches 17. The key switch 17 of the keyboard 14 of the embodiment is one of the key switches of the first to sixth embodiments.

An LCD (liquid crystal display) panel module 18, for example, is incorporated in the housing 13. A user of the notebook PC 11 confirms an operation of the notebook PC 11 in accordance with texts and graphics that are displayed on a screen of the LCD panel module 18.

Figure 36B:
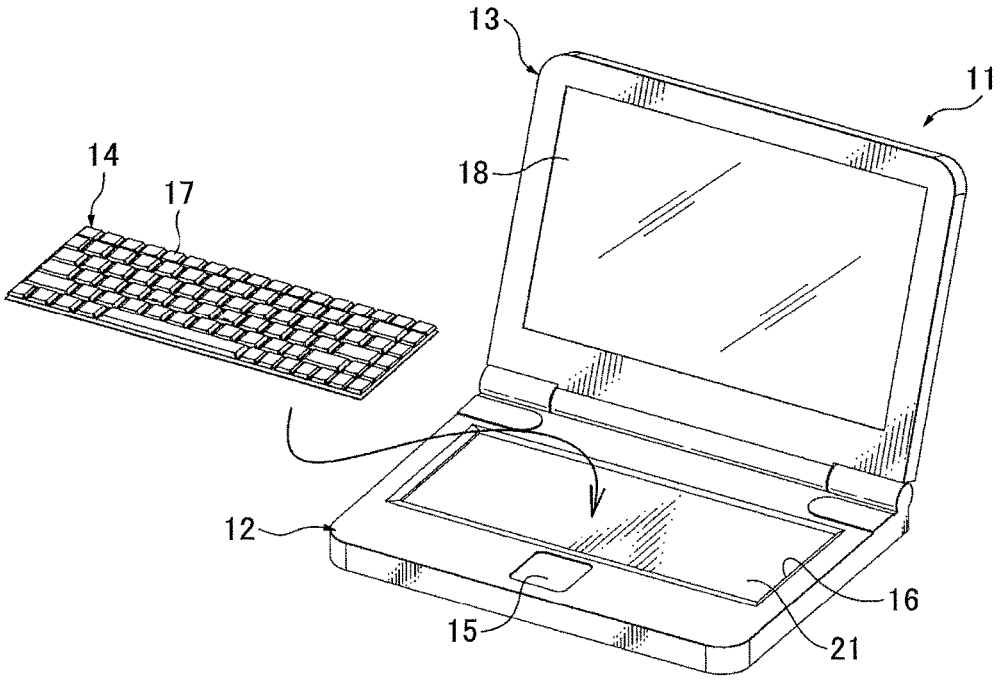

FIG. 36B is an exploded perspective view illustrating the main housing 12 from which the keyboard 14 is removed. As illustrated in FIG. 36B, the keyboard 14 is fixed on a support plate 21 that is provided in the opening 16. The support plate 21 has a flat surface, and the keyboard 14 can be retained flat by this flat surface. The support plate 21 may be formed by a metal material such as a stainless steel, a resin material such as a plastic, or the like, for example. When fixing the keyboard 14 in the opening 16, a screw, not illustrated in the drawings, is used, for example. The screw is screwed to the support plate 21 through a threaded hole, not illustrated in the drawings, provided in the keyboard 14.

According to the key switch of the embodiment, data can be smoothly input by a keyboard without lowing usability even when the key switch is thin.

Although a preferred embodiment of the key switch and the keyboard has been specifically illustrated and described, it is to be understood that minor modifications may be made therein without departing from the spirit and scope of the invention as defined by the claims.

The present invention is not limited to the specifically disclosed embodiments, and numerous variations and modifications may be made without departing from the spirit and scope of the present invention.

What is claimed is:

1. A key switch comprising:
a key top;
a pair of links that support the key top such that the key top is capable of being elevated and lowered; and
a switch that opens and closes a contact point in accordance with an elevating operation of the key top,
wherein each of the links includes
two arms,
a connection portion that connects the two arms,
two first shafts respectively formed at outer portions of the two arms, and
two second shafts respectively formed at inner portions of the two arms, and
wherein the key top includes
at least four first support portions each being provided with a first guide groove in which the respective first shaft is slidable, and
at least four second support portions each being provided with a second guide groove in which the respective second shaft is slidable.

2. The key switch according to claim 1, wherein two of the second support portions are connected with each other.

3. The key switch according to claim 1, wherein the first support portions of one of the links are respectively connected to the first support portions of the other of the links.

4. The key switch according to claim 1, wherein two of the second shafts facing with each other are connected with each other.

5. The key switch according to claim 1, wherein the second shaft is longer than the first shaft.

6. A key switch comprising:
a key top;
a pair of links that support the key top such that the key top is capable of being elevated and lowered; and
a switch that opens and closes a contact point in accordance with respect to an elevating operation of the key top,
wherein each of the links includes
two arms,
a connection portion that connects the two arms,
a center arm provided between the two arms,
two first shafts respectively formed at outer portions of the two arms, and
two second shafts formed at portions of the center arm, the portions facing the two arms, respectively, and
wherein the key top includes
at least four first support portions each being provided with a first guide groove in which the respective first shaft is slidable, and
at least four second support portions each being provided with a second guide groove in which the respective second shaft is slidable.

7. The key switch according to claim 6, wherein the second shaft is longer than the first shaft.

* * * * *